US008733592B2

(12) United States Patent
Kitano et al.

(10) Patent No.: US 8,733,592 B2
(45) Date of Patent: May 27, 2014

(54) LIQUID DELIVERY SYSTEM, LIQUID-DELIVERY SWITCHING DEVICE, AND LIQUID-FLOWPATH REGULATING DEVICE

(75) Inventors: Junichi Kitano, Moriya (JP); Takashi Wada, Kobe (JP); Kenji Kusunoki, Kobe (JP)

(73) Assignees: Asahi Breweries, Ltd., Tokyo (JP); Kyokko Electric Co. Ltd., Kobe-shi (JP)

( * ) Notice: Subject to any disclaimer, the term of this patent is extended or adjusted under 35 U.S.C. 154(b) by 0 days.

(21) Appl. No.: 13/376,179

(22) PCT Filed: Jun. 2, 2010

(86) PCT No.: PCT/JP2010/059396

§ 371 (c)(1),
(2), (4) Date: Dec. 2, 2011

(87) PCT Pub. No.: WO2010/140641

PCT Pub. Date: Dec. 9, 2010

(65) Prior Publication Data

US 2012/0085781 A1 Apr. 12, 2012

(30) Foreign Application Priority Data

Jun. 3, 2009 (JP) ..... 2009-133714
Jun. 3, 2009 (JP) ..... 2009-133727

(51) Int. Cl.
*B67D 1/00* (2006.01)
*B67D 7/14* (2010.01)

(52) U.S. Cl.
USPC ..... 222/64; 222/61; 222/66; 222/59

(58) Field of Classification Search
USPC ..... 222/59, 64, 61, 65, 66, 135
See application file for complete search history.

(56) References Cited

U.S. PATENT DOCUMENTS 3,878,970 A * 4/1975 Nezworski ..... 222/61
4,377,246 A * 3/1983 McMillin et al. ..... 222/56

(Continued)

FOREIGN PATENT DOCUMENTS

EP 235437 A1 * 9/1987 ..... B67D 1/12
EP 353104 A1 * 1/1990 ..... B67D 1/12

(Continued)

OTHER PUBLICATIONS

JP 05319489 A—English Translation.*

(Continued)

*Primary Examiner* — Paul R Durand
*Assistant Examiner* — Benjamin R Shaw
(74) *Attorney, Agent, or Firm* — James W. Judge

(57) ABSTRACT

A liquid supply system capable of being serviced and hygienically maintained easily. A beer storage barrel switching device (12) uninterruptedly supplies beer by switching between beer storage barrels (21-1, 21-2). A first connection tube (23-1) is provided with a fluid stopper device (31-1) including a loop section. The fluid stopper device (31-1) switches between a suppliable state in which it is possible to supply the beer to a dispenser (11) through the first connection tube (23-1) and a non-suppliable state in which it is not possible to supply the beer. Using the fluid stopper device (31-1) eliminates the need to provide a conventional valve in the middle of the first connection tube (23-1), the conventional valve having a structural element which comes in direct contact with the beer. Accordingly, the case that a cleaning member, such as a sponge, is caught by the valve does not occur, and this enables the inner wall of the first connection tube (23-1) to be cleaned using the cleaning member. As a result, a beverage, such as beer, can be easily maintained hygienically and served.

11 Claims, 27 Drawing Sheets

(56) References Cited

U.S. PATENT DOCUMENTS

| | | | | | |
|---|---|---|---|---|---|
| 4,406,382 | A * | 9/1983 | Roth | 222/64 |
| 7,832,592 | B2 * | 11/2010 | Bodemann | 222/53 |
| 2005/0224523 | A1 * | 10/2005 | O'Dougherty et al. | 222/399 |
| 2006/0169715 | A1 * | 8/2006 | Emmendorfer et al. | 222/59 |

FOREIGN PATENT DOCUMENTS

| | | | | | |
|---|---|---|---|---|---|
| GB | 2415952 | A | | 1/2006 | |
| JP | 05319489 | A | * | 12/1993 | B67D 1/14 |
| JP | 06064690 | A | * | 3/1994 | B67D 1/08 |
| JP | 2007-182250 | A | | 7/2007 | |
| JP | 2008256096 | A | * | 10/2008 | |
| JP | 2009026009 | A | * | 2/2009 | |
| WO | WO-2008-043186 | A1 | | 4/2008 | |
| WO | WO-2008-147199 | A2 | | 12/2008 | |

OTHER PUBLICATIONS

JP 2008256096 A—English Translation.*

* cited by examiner

*FIG. 7*

| | First beer-delivery network section 13 | | Second beer-delivery network section 15 | |
|---|---|---|---|---|
| | Liquid cutoff device 31-1 | Liquid cutoff device 33-1 | Liquid cutoff device 31-2 | Liquid cutoff device 33-2 |
| State 1 | ○ | × | × | × |
| State 2 | × | × | ○ | × |
| State 3 | × | ○ | ○ | × |

Delivery enabled → ○

Delivery disabled → ×

*FIG. 14*

| | First beer-delivery network section 13 | | | Second beer-delivery network section 15 | | |
|---|---|---|---|---|---|---|
| | Liquid cutoff device 31-1 | Liquid cutoff device 33-1 | Pressure-switching device 73-1 | Liquid cutoff device 31-2 | Liquid cutoff device 33-2 | Pressure-switching device 73-2 |
| State 1 | ○ | × | ○ | × | × | × |
| State 2 | × | × | × | ○ | × | ○ |
| State 3 | × | ○ | ○ | ○ | × | ○ |

Delivery enabled → ○

Delivery disabled → ×

*FIG. 16*

| | | First beer-delivery network section 13 | | Second beer-delivery network section 15 | |
|---|---|---|---|---|---|
| | | Liquid cutoff device 31-1 | Liquid cutoff device 33-1 | Liquid cutoff device 31-2 | Liquid cutoff device 33-2 |
| State 1 | | ○ | × | × | × |
| State 2 | | × | × | ○ | × |
| State 11 | a | × | ○ | ○ | × |
| | b | × | × | ○ | × |

Delivery enabled → ○

Delivery disabled → ×

FIG. 18

| | | First beer-delivery network section 13 | | | Second beer-delivery network section 15 | | |
|---|---|---|---|---|---|---|---|
| | | Liquid cutoff device 31-1 | Liquid cutoff device 33-1 | Pressure-switching device 73-1 | Liquid cutoff device 31-2 | Liquid cutoff device 33-2 | Pressure-switching device 73-2 |
| State 1 | | ○ | × | ○ | × | × | × |
| State 2 | | × | × | × | ○ | × | ○ |
| State 11 | a | × | ○ | × | ○ | × | ○ |
| | b | × | ○ | ○ | ○ | × | ○ |
| | c | × | ○ | × | ○ | × | ○ |
| | d | × | × | × | ○ | × | ○ |

Delivery enabled →○
Delivery disabled →×

FIG. 20

| | | First beer-delivery network section 13 | | Second beer-delivery network section 15 | |
|---|---|---|---|---|---|
| | | Liquid cutoff device 31-1 | Liquid cutoff device 33-1 | Liquid cutoff device 31-2 | Liquid cutoff device 33-2 |
| State 1 | | ○ | × | × | × |
| State 2 | | × | × | ○ | × |
| State 5 | a | × | ○ | ○ | × |
| | b | × | × | ○ | × |
| | c | ○ | × | ○ | × |
| State 3 | | × | ○ | ○ | × |

Delivery enabled → ○

Delivery disabled → ×

*FIG. 22*

| | | First beer-delivery network section 13 | | | First beer-delivery network section 15 | | |
|---|---|---|---|---|---|---|---|
| | | Liquid cutoff device 31-1 | Liquid cutoff device 33-1 | Pressure-switching device 73-1 | Liquid cutoff device 31-2 | Liquid cutoff device 33-2 | Pressure-switching device 73-2 |
| State 1 | | ○ | × | ○ | × | × | × |
| State 2 | | × | × | × | ○ | × | ○ |
| State 15 | a | × | ○ | × | ○ | × | ○ |
| | b | × | × | × | ○ | × | ○ |
| | c | ○ | × | × | ○ | × | ○ |
| State 3 | | × | ○ | ○ | ○ | × | ○ |

Delivery enabled → ○

Delivery disabled → ×

LIQUID DELIVERY SYSTEM, LIQUID-DELIVERY SWITCHING DEVICE, AND LIQUID-FLOWPATH REGULATING DEVICE

TECHNICAL FIELD

The present invention relates to liquid delivery systems, and in particular relates to a liquid delivery system that facilitates maintenance management and hygiene management.

BACKGROUND ART

Using FIG. 27, an explanation of a conventional liquid delivery system that is a beer tapping device will be explained. In the case of a beer dispensing device 101A, the presence or absence of beer from each of beer kegs 102A, 102B, delivered to a dispenser 120 by way of each of beer flowpath switching valves 118, a conduit 108, and a branching valve 117 is detected by each of beer sensors 109. At first, in a situation where, for example, when a one beer keg 102A has run out of beer and is replaced with a fresh beer keg and the fresh beer keg is tapped, until the beer sensor 109 detects that there is beer, the beer flowpath switching valve 118 is switched over to a debubbling valve 119 side, to carry out discharging of bubbles in the conduit 108 through the debubbling valve 119. After the beer sensor 109 has detected the presence of beer, through a fixed time period (approximately two seconds) the bubble-discharging state is continued, and subsequently the beer flowpath switching valve 118 switches the flowpath over to the conduit 108 side. The beer from the in-use beer keg—that is, beer keg 102A or 102B—is thereby delivered to the dispenser 120 by way of the beer flowpath switching valve 118, the conduit 108, and the branching valve 117. On the other hand, if for example the beer sensor 109 on the beer keg 102A side detects that there is no beer, the branching valve 117 operates, whereby the conduit 108 on the beer keg 102B side is communicated with the dispenser 120. This results in the beer keg 102A being cut off from the conduit 108 and the beer keg 102B being connected to the conduit 108, enabling the supply of beer by the beer keg 102B following on the beer keg 102A to be carried out automatically. In this way, by means of the beer dispensing device 101A, the presence/absence of beer in a plurality of beer kegs 102A, 1028 is detected by the respective beer sensors 109, and with a keg in which the beer in its essence has gone empty being replaced in succession with a fresh beer keg without interruption, debubbling through the conduit 108 by the valve 119 at the outset of use of a fresh keg is carried out, while cutoff of the empty beer keg 102A through its conduit 108 and connection to a full beer keg 102B via its conduit 108 are carried out by the branching valve 117 without interruption, whereby, with unnecessary bubbles that arise during replacement of the beer kegs 102 being eliminated, good-quality beer may be dispensed continuously for a long period of time.

PRIOR TECHNICAL LITERATURE

Patent Literature

Patent Reference 1: Japanese Unexamined Pat. App. Pub. No. H05-319489.

SUMMARY OF INVENTION

Issue Invention is to Solve

With the conventional beer dispensing device 101A discussed above, the below-indicated points for improvement exist. In the beer dispensing device 101A, the beer flowpath switching valve 118 is employed to switch the supply of beer from the beer kegs 102A, 102B to the dispenser 120. As a consequence of use grime clings to the interior of the conduit 108 though which beer flows. Furthermore, grime is particularly liable to cling to the beer flowpath switching valve 118. Consequently, it is necessary to wash the conduit 108 and the beer flowpath switching valve 118 periodically.

In the washing, there are occasions when just a water rinse in which water is flowed to rinse out the interior is sufficient, but periodically it is necessary to carry out sponge-washing in order to wash more cleanly. In those instances, as far as the conduit 108 is concerned sponge-washing is possible.

Nevertheless, as far as the beer flowpath switching valve 118 is concerned sponge-washing is impossible, and as a result it must be detached and, for example, given a dismantle-washing. Thus, an aspect for improvement that exists with the beer dispensing device 101A employing the beer flowpath switching valve 118 is that very involved work is required for maintenance management and hygiene management.

And in cases where, for example, the beer keg 102A has become empty and is replaced with a fresh keg 102A, the interior of the conduit 108 where it leads from the beer keg 102A to the dispenser 120 via the beer flowpath switching valve 118 and the branching valve 117 will for the most part be filled with beer. In that respect, beer kegs are generally put under high pressure interiorly, for sustaining the quality of the beer and for other reasons. Consequently, when a beer keg 102A that has gone empty is changed out and a freshly readied beer keg 102A is connected in, it turns out that the high pressure acting on the interior of the beer keg 102A is applied all at once to the interior of the conduit 108. Meanwhile, beer is already present in the interior of the conduit 108. A point for improvement is that with no place for the beer in the interior of the conduit 108 to escape, consequently rupturing occurs in the joints with the beer flowpath switching valve 118 and the branching valve 117, or else along the conduit 108 partway, such that beer leaks to the exterior.

Therein, an object of the present invention is to make available a liquid delivery system that enables maintenance management and hygiene management to be conducted with ease.

A further object of the present invention is to make available a liquid delivery system in which there is no leaking of liquid to the exterior when the liquid-storage vessels are replaced.

Advantageous Effects of Invention

The means whereby the issues are resolved under the present invention, and the advantageous effects of the invention are indicated below.

With a liquid-delivery system and liquid-delivery switching device involving the present invention, a liquid-delivery switching device switches among a plurality of liquid-storage vessels that store a liquid, and delivers the liquid to a liquid external-delivery device that delivers the liquid externally, and includes: a delivery conduit connecting the liquid-storage vessels each with the liquid external-delivery device, and forming a delivery flowpath from the liquid-storage vessels to the liquid external-delivery device; a discharge conduit branching from a branch part in a predetermined location in the delivery conduit, and forming a discharge flowpath from the liquid-storage vessels; delivery-conduit opening/closing means arranged in a predetermined location along the delivery conduit, the delivery-conduit opening/closing means for switching between a delivery-enabled state in which the liquid can be delivered via the delivery conduit, and a delivery-disabled state being a state in which via the delivery conduit delivery of the liquid cannot take place; and discharge-conduit opening/closing means arranged in a predetermined location along the discharge conduit, the discharge-conduit opening/closing means for switching between a delivery-enabled state in which the liquid can be delivered via the discharge conduit, and a delivery-disabled state being a state in which via the discharge conduit delivery of the liquid cannot take place; characterized in that the delivery-conduit opening/closing means switches from the delivery-enabled state to the delivery-disabled state by forming a kink bending a portion of the delivery conduit, and switches from the delivery-disabled state to the delivery-enabled state by undoing the kink.

This eliminates the necessity of arranging, along the way of the delivery conduit, conventional valves, such as electromagnetic valves, having structural components that come into contact directly with the beer. Accordingly, sponges and other washing implements getting caught in valves is not an issue, such that a washing implement can be utilized to wash the inner wall of the delivery conduit. Facilitated performance of hygiene management in supplying liquids is thus made possible. This is particularly beneficial when the liquid is a beverage substance.

And since the delivery-conduit opening/closing means has no structural components that come into contact directly with the liquid, there is no negative impact on the system operation that would arise owing to constituents of the liquid clinging to the structural components. That is, the necessity, as with conventional valves, of performing a dismantle-washing or other such job of periodically washing structural components is eliminated. What is more, the mixing-in of foreign matter due to friction, damage, etc. associated with the operation of structural components can be averted. Performing hygiene management with ease in supplying liquids is accordingly possible. This is particularly beneficial when the liquid is a beverage substance. Further, since there is no clinging of liquid constituents to structural components, the propagation, which would owe to that factor, of germs and the like does not arise. For these reasons, the hygienic state of the liquid-delivery system can be easily, favorably maintained.

With a liquid-delivery switching device involving the present invention, furthermore, the discharge-conduit opening/closing means switches from the delivery-enabled state to the delivery-disabled state by forming a kink bending a portion of the delivery conduit, and switches from the delivery-disabled state to the delivery-enabled state by undoing the kink.

This makes it possible to reliably wash the discharge conduit as well.

With a liquid-delivery switching device involving the present invention, when the liquid supplied from the liquid external-delivery device is changed over from what a given liquid-storage vessel stores to what another liquid-storage vessel stores, the delivery-conduit opening/closing means and the discharge-conduit opening/closing means for the pre-changeover liquid-storage vessel are put into the delivery-disabled state, and the delivery-conduit opening/closing means for the post-changeover liquid-storage vessel is put into the delivery-enabled state, and after the pre-changeover liquid-storage vessel has been replaced with a fresh vessel, when the replacing liquid-storage vessel and the delivery conduit are connected, the delivery-conduit opening/closing means is put into the delivery-disabled state and the discharge-conduit opening/closing means is put into the delivery-enabled state.

This makes possible, in supplying beer, the changing over from beer storage keg 21-1 to beer storage keg 21-2 without the delivery of beer pausing.

With a liquid-delivery switching device involving the present invention, after the discharge-conduit opening/closing means has been put into the delivery-enabled state, following the elapse of a predetermined period of time, it is put into the delivery-disabled state.

The state of the discharge-conduit opening/closing means can thereby be easily and reliably switched. Thus, the serviceability of the liquid-delivery switching device can be improved.

A liquid-delivery switching device involving the present invention further includes: a first sensing means arranged in a predetermined location along the delivery conduit, the first sensing means for detecting a liquid delivery status being the status of delivery of liquid through the delivery conduit; and a control means for controlling the switching between the delivery-enabled state and the delivery-disabled state both of the delivery-conduit opening/closing means and of the discharge-conduit opening/closing means; characterized in that the control means has a first sensing-result acquisition means for acquiring the first sensing means' sensing results, a first liquid-supply determining means for determining, based on the sensing results, the liquid-delivering status of the delivery conduit, and a switching-control means for putting the delivery-conduit opening/closing means into the delivery-disabled state if it has been determined, based on the liquid-delivering status, that delivery of the liquid has concluded, and for putting the discharge-conduit opening/closing means into the delivery-enabled state, with the delivery-conduit opening/closing means left in the delivery-disabled state, if it has been determined, based on the liquid-delivering status, that delivery of the liquid has started.

The delivery-conduit opening/closing means and the discharge-conduit opening/closing means can thereby be automatically switched between the delivery-enabled state and the delivery-disabled state. Thus, in utilizing the liquid-delivery switching device the working efficiency is enhanced.

A liquid-delivery switching device involving the present invention includes: a first sensing means arranged in a predetermined location along the delivery conduit, the first sensing means for detecting a liquid delivery status being the status of delivery of liquid through the delivery conduit; a replacement completion means for presenting replacement-complete information indicating that a pre-changeover liquid-storage vessel has been replaced with a fresh vessel; and a control means for controlling the switching between the delivery-enabled state and the delivery-disabled state both of the delivery-conduit opening/closing means and of the discharge-conduit opening/closing means; wherein the control means has a first sensing-result acquisition means for acquiring the first sensing means' sensing results, a replacement-complete-information acquisition means for acquiring the replacement-complete information, a first liquid-supply determining means for determining, based on the sensing results, the liquid-delivering status of the delivery conduit, and a switching-control means for putting the delivery-conduit opening/closing means into the delivery-disabled state if it has been determined, based on the liquid-delivering status, that delivery of the liquid has concluded, and for putting the discharge-conduit opening/closing means into the delivery-enabled state, with the delivery-conduit opening/closing means left in the delivery-disabled state, when the control means acquires the replacement-complete information.

Replacement of the liquid-storage vessels can thereby be reliably comprehended, such that accidental replacement, due to erroneous sensing by the first sensing means, of a liquid-storage vessel in which liquid remains is eliminated. Thus, the efficiency with which the liquid-storage vessels are employed can be heightened.

With a liquid-delivery switching device involving the present invention, the device includes: a first sensing means arranged in a predetermined location along the delivery conduit, the first sensing means for detecting a liquid delivery status being the status of delivery of liquid through the delivery conduit; a connection-commencement notification means provided on a connecting member for connecting a liquid-storage vessel and the delivery conduit, for presenting connection-commencement information when connection between a liquid-storage vessel and the delivery conduit begins; and a control means for controlling the switching between the delivery-enabled state and the delivery-disabled state both of the delivery-conduit opening/closing means and of the discharge-conduit opening/closing means; wherein the control means has a first sensing-result acquisition means for acquiring the first sensing means' sensing results, a connection-commencement-information acquisition means for acquiring the connection-commencement information, a first liquid-supply determining means for determining, based on the sensing results, the liquid-delivering status of the delivery conduit, and a switching-control means for putting the delivery-conduit opening/closing means into the delivery-disabled state if it has been determined, based on the liquid-delivering status, that delivery of the liquid has concluded, and for putting the discharge-conduit opening/closing means into the delivery-enabled state, with the delivery-conduit opening/closing means left in the delivery-disabled state, when the control means acquires the connection-commencement information.

Replacing a liquid-storage vessel thereby converts the state of each opening/closing means automatically, whereby the working efficiency can be raised.

In a liquid-delivery switching device involving the present invention, the switching-control means, following the elapse of a predetermined period of time after putting the discharge-conduit opening/closing means into the delivery-enabled state, furthermore puts the discharge-conduit opening/closing means into the delivery-disabled state.

Reliably state-converting the discharge-conduit opening/closing means is thereby possible.

A liquid-delivery switching device involving the present invention further includes: a second sensing means arranged in a predetermined location along the discharge conduit, the second sensing means for detecting a liquid delivery status being the delivery status of the liquid from the discharge conduit; wherein the control means further includes a second sensing-result acquisition means for acquiring the second sensing means' sensing results, and a second liquid-supply determining means for determining, based on the sensing results, the liquid-delivering status of the discharge conduit, and the switching-control means further puts the discharge-conduit opening/closing means into the delivery-disabled state if it has been determined, based on the liquid-delivering status of the discharge conduit, that the status is the liquid may be delivered from the delivery conduit.

This enables the state of the waste-liquid conduit opening/closing means to be switched automatically when the situation is that liquid from a liquid-storage vessel is delivered. That is, preparation for using a fresh liquid-storage vessel can be carried out reliably.

A liquid-delivery switching device involving the present invention further includes: a pressure supply means for supplying pressure in order to deliver the liquid from the liquid-storage vessels; pressure-supply conduits connected with each of the plurality of liquid-storage vessels; and pressure-supply conduit opening/closing means for switching between a pressure-supply enabled state in which via whichever of the pressure-supply conduits, supplying pressure to the liquid-storage vessel connected to that pressure-supply conduit is possible, and a pressure-supply disabled state in which supplying pressure to that liquid-storage vessel is not possible.

The need to ready a pressure-supply means liquid-storage vessel by liquid-storage vessel is thereby eliminated, such that the economic aspect of running the liquid-delivery system can be improved.

In a liquid-delivery switching device involving the present invention, the switching-control means, when the liquid supplied from the liquid external-delivery device is changed over from what a given liquid-storage vessel stores to what another liquid-storage vessel stores, puts the pressure-supply conduit opening/closing means that supplies pressure to the pre-changeover liquid-storage vessel into the pressure-supply disabled state and puts the pressure-supply conduit opening/closing means that supplies pressure to the post-changeover liquid-storage vessel into the pressure-supply enabled state, and after the pre-changeover liquid-storage vessel has been replaced with a fresh vessel, when the replacing liquid-storage vessel and the delivery conduit are connected, puts the pressure-supply conduit opening/closing means that supplies pressure to the replacing liquid-storage vessel into the pressure-supply enabled state.

This enables the pressure-supply conduit opening/closing means to be switched automatically. Thus, the efficiency with which the liquid-delivery switching device is employed can be heightened.

In a liquid-delivery switching device involving the present invention, the discharge conduit is disposed more upward than the delivery conduit. This makes it possible for discharging of bubbles from the discharge conduit to take place efficiently, inasmuch as the bubbles are lighter than the liquid.

With a liquid-delivery device involving the present invention, when the liquid supplied from the liquid external-delivery device is changed over from what a given liquid-storage vessel stores to what another liquid-storage vessel stores, the delivery-conduit opening/closing means for the pre-changeover liquid-storage vessel is put into the delivery-disabled state, after which the discharge-conduit opening/closing means is for a predetermined time period put into the delivery-enabled state, and thereafter the delivery-conduit opening/closing means is put into the delivery-enabled state.

This makes it possible to prevent the delivery-conduit opening/closing means from being put into the delivery-disabled state for a prolonged period. Thus, traces of kinks that hinder the movement of the sponge in sponge-washing the delivery-conduit opening/closing means can be kept from forming.

In a liquid-delivery device involving the present invention, the delivery-conduit opening/closing means further includes: a support part confining the form of the delivery conduit into a looped conformation; a movable part impressing a portion of the delivery conduit in the looped conformation, the movable part for transforming the looped conformation of the delivery conduit by varying the delivery-conduit impressing condition; and a movement controller for iteratively transforming the looped conformation of the delivery conduit while sustaining its delivery-enabled state.

This makes it possible, in situations where traces of kinks form in the delivery conduit and the movement of the sponge in sponge-washing does not go well, by iteratively transforming the looped conformation to cause the sponge to move smoothly inside the delivery conduit. Sponge-washing can thus be reliably carried out.

With a liquid-delivery device involving the present invention, the device includes a manually switched discharge-conduit opening/closing means arranged in the discharge conduit, for enabling by a user's manual operation switching between the delivery-enabled state and the delivery-disabled state.

This makes it possible to put the discharge conduit into the delivery-disabled state manually even should the discharge-conduit opening/closing means be out of order, whereby unintentional discharging of the liquid can be prevented.

With a liquid-delivery device involving the present invention, the discharge conduit is of thickness allowing the conduit to sustain the delivery-disabled state against changes in temperature. The kink can thereby be stopped from going slack due to temperature changes. Hence, the delivery-disabled state of the discharge-conduit opening/closing means can be sustained even should there be a change in temperature. This means that unintentional discharging of the liquid can be prevented.

With a liquid-delivery device involving the present invention, the device is characterized in that the pressure-supply conduit opening/closing means is at ordinary times in the supply-enabled state. This ensures that the pressure will be in the delivery-enabled state even should the pressure-supply conduit opening/closing means be out of order, whereby delivery of the liquid can be kept up.

With a liquid-delivery system and liquid-flowpath regulating device involving the present invention, the liquid-delivery system has a liquid-storage vessel storing a liquid, a liquid external-delivery device that delivers the liquid externally, and a liquid-flowpath regulating device that regulates a flowpath of liquid flowing in between the liquid-storage vessel and the liquid external-delivery device, wherein: the liquid-flowpath regulating device includes a delivery conduit connecting the liquid-storage vessel and the liquid external-delivery device, and forming a delivery flowpath from the liquid-storage vessel to the liquid external-delivery device, a discharge conduit branching from a branch part in a predetermined location in the delivery conduit, and forming a discharge flowpath from the liquid-storage vessel, a delivery-conduit opening/closing means arranged in a predetermined location along the delivery conduit, the delivery-conduit opening/closing means for switching between a delivery-enabled state in which the liquid can be delivered via the delivery conduit, and a delivery-disabled state being a state in which via the delivery conduit delivery of the liquid cannot take place, and a discharge-conduit opening/closing means arranged in a predetermined location along the discharge conduit, the discharge-conduit opening/closing means for switching between a delivery-enabled state in which the liquid can be delivered via the discharge conduit member, and a delivery-disabled state being a state in which via a second connecting flowpath member delivery of the liquid cannot take place; and the liquid-flowpath regulating device puts the delivery-conduit opening/closing means and the discharge-conduit opening/closing means into the delivery-disabled state when delivery of the liquid from the liquid-storage vessel concludes, and thereafter puts the discharge-conduit opening/closing means into the delivery-enabled state.

This makes it possible to put the discharge conduit into an emptied state when delivery of the liquid from a liquid-storage vessel concludes. Accordingly, when the liquid-storage vessel is replaced following the conclusion of delivery of the liquid from the liquid-storage vessel, the pressure from the liquid-storage vessel can be vented through the discharge conduit to the exterior. Thus, during liquid-storage vessel replacement, rupturing of the delivery conduit due to high pressure from the liquid-storage vessel can be prevented.

With a liquid-flowpath regulating device involving the present invention, furthermore, following the elapse of a predetermined period of time after the discharge-conduit opening/closing means has been put into the delivery-enabled state, the discharge-conduit opening/closing means is put into the delivery-disabled state.

This ensures that the pressure for delivering the liquid will not end up escaping from the discharge conduit to the exterior. That is, in cases where the pressure for delivering the liquid is created by the pressure from supplying a gas, etc., leaking of the gas, etc. from the discharge conduit to the exterior can be prevented. In this way preventing exterior leakage of the gas, etc. that supplies the pressure for delivering the liquid is especially beneficial when a gas tank or other pressure-supplying means is provided externally to the liquid-storage vessel. In that case, the pressure-supplying means supplies pressure not just to a single liquid-storage vessel, but also to post-replacement liquid-storage vessels. Accordingly, the fact that, at the conclusion of delivery of liquid from a single liquid-storage vessel, exterior leakage of the gas, etc. from the discharge conduit is prevented makes extending the use-period of the pressure-supplying means possible. That means that efficient, economical liquid delivery is made possible.

A liquid-flowpath regulating device involving the present invention further includes: a first sensing means arranged in a predetermined location along the delivery conduit, the first sensing means for detecting a liquid delivery status being the status of delivery of liquid through the delivery conduit; and a control means for controlling the switching between the delivery-enabled state and the delivery-disabled state both of the delivery-conduit opening/closing means and of the discharge-conduit opening/closing means; wherein the control means has a first sensing-result acquisition means for acquiring the first sensing means' sensing results, a first liquid-supply determining means for determining, based on the sensing results, the liquid-delivering status of the delivery conduit, and a flowpath-control means for putting the delivery-conduit opening/closing means into the delivery-disabled state, and putting the discharge-conduit opening/closing means into the delivery-enabled state, if it has been determined, based on the liquid-delivering status, that delivery of the liquid has concluded.

This enables putting the discharge conduit into an emptied state automatically, based on the first sensing means' sensing results.

With a liquid-flowpath regulating device involving the present invention, the device further includes: a first sensing means arranged in a predetermined location along the delivery conduit, the first sensing means for detecting a liquid delivery status being the status of delivery of liquid through the delivery conduit; a connection-commencement notification means provided on a connecting member for connecting a liquid-storage vessel and the delivery conduit, for presenting connection-commencement information when connection between a liquid-storage vessel and the delivery conduit begins; and a control means for controlling the switching between the delivery-enabled state and the delivery-disabled state both of the delivery-conduit opening/closing means and of the discharge-conduit opening/closing means; wherein the control means has a first sensing-result acquisition means for acquiring the first sensing means' sensing results, a connection-commencement-information acquisition means for acquiring the connection-commencement information, a first liquid-supply determining means for determining, based on the sensing results, the liquid-delivering status of the delivery conduit, and a flowpath-control means for putting the delivery-conduit opening/closing means into the delivery-disabled state if it has been determined, based on the liquid-delivering status, that delivery of the liquid has concluded, and for putting the discharge-conduit opening/closing means into the delivery-enabled state, with the delivery-conduit opening/closing means left in the delivery-disabled state, when the control means acquires the connection-commencement information.

Simultaneously with replacement of a liquid-storage vessel, the discharge-conduit opening/closing means can thereby be put into the delivery-enabled state, securing a discharge flowpath. Thus, in replacing a liquid-storage vessel, rupturing of the delivery conduit due to the high pressure from the liquid-storage vessel may be definitively prevented.

With a liquid-flowpath regulating device involving the present invention, the flowpath-control means furthermore, following the elapse of a predetermined period of time after putting the discharge-conduit opening/closing means into the delivery-enabled state, puts the discharge-conduit opening/closing means into the delivery-disabled state.

The discharge-conduit opening/closing means can thereby be put into the delivery-disabled state automatically after the discharge conduit has been put into an emptied state. Thus, economical delivery of liquid can be carried out automatically.

A liquid-flowpath regulating device involving the present invention further includes a second sensing means arranged in a predetermined location along the discharge conduit, the second sensing means for detecting a liquid delivery status being the status of delivery of liquid through the discharge conduit; wherein: the control means further includes a second sensing-result acquisition means for acquiring the second sensing means' sensing results, and a second liquid-supply determining means for determining, based on the sensing results, the liquid-delivering status of the discharge conduit; and the flowpath-control means further puts the discharge-conduit opening/closing means into the delivery-disabled state if it has been determined, based on the liquid-delivering status of the discharge conduit, that the discharge conduit is in an emptied state.

This enables, based on the liquid delivery status of the discharge conduit after the discharge conduit has been put into an emptied state, putting the discharge-conduit opening/closing means into the delivery-disabled state automatically. Thus, based on the liquid delivery status of the discharge conduit, economical delivery of liquid can be carried out automatically.

A liquid-flowpath regulating device involving the present invention further includes: a pressure supply means for supplying pressure in order to deliver the liquid from the liquid-storage vessels; pressure-supply conduits connecting the pressure supply means with the liquid-storage vessels; and a pressure-supply conduit opening/closing means for switching between a pressure-supply enabled state in which via a pressure-supply conduit, supplying pressure to the liquid-storage vessel connected to that pressure-supply conduit is possible, and a pressure-supply disabled state in which supplying pressure to that liquid-storage vessel is not possible.

This makes it possible to put the discharge conduit into an emptied state when delivery of the liquid from a liquid-storage vessel concludes. Accordingly, when the liquid-storage vessel is replaced following the conclusion of delivery of the liquid from the liquid-storage vessel, the pressure from the liquid-storage vessel can be vented through the discharge conduit to the exterior. Thus, during liquid-storage vessel replacement, rupturing of the delivery conduit due to high pressure from the liquid-storage vessel can be prevented.

With a liquid-flowpath regulating device involving the present invention, the flowpath-control means, in putting the discharge-conduit opening/closing means into the delivery-disabled state following the elapse of a predetermined period of time after having put it into the into the delivery-enabled state, puts the pressure-supply conduit opening/closing means supplying pressure to the liquid-storage vessels into the pressure-supply disabled state.

This ensures that the pressure that the pressure-supply means supplies for delivering the liquid will not end up escaping from the discharge conduit to the exterior. That is, the fact that, at the conclusion of delivery of liquid from a single liquid-storage vessel, the pressure from the discharge conduit is stopped from escaping out of control makes extending the use-period of the pressure-supplying means possible. That means that efficient, economical liquid delivery becomes possible.

In a liquid-flowpath regulating device involving the present invention, the discharge conduit is disposed upward of the delivery conduit. this makes it possible for discharging of bubbles from the discharge conduit to take place efficiently, inasmuch as the bubbles are lighter than the liquid.

Herein, the correspondence relationships between the structural Components in the scope of the patent claims, and the structural components of The embodiment examples will be indicated. The liquid delivery system Corresponds to the beer delivery systems 1 and 51. Corresponding Respectively are: the liquid-storage vessels to the beer storage kegs 21-1 and 21-2; the liquid external-delivery device to the dispenser 11; the liquid-delivery switching device to the beer storage-keg switching devices 12 and 52; and the liquid-flowpath regulating device to the beer storage-keg switching devices 12 and 52. Corresponding respectively are the delivery-conduit opening/closing means to the cutoff devices 31-1 and 31-2, and the discharge-conduit opening/closing means to the cutoff devices 33-1 and 33-2. Corresponding respectively are the first sensing means to the beer-detection sensors 35-1 and 35-2, and the second sensing means to the beer-detection sensor 39. The pressure-supplying means corresponds to the carbon dioxide tanks 21-1, 21-2 and 72. The pressure-supply conduit opening/closing means corresponds to the pressure-switching devices 71-1 and 71-2.

The control means corresponds to the CPU 411 and the memory 412. The first sensing-result acquisition means and the second sensing-result acquisition means each correspond to the CPU 411, the memory 412, and the communications circuitry 418. The first liquid-supply determining means and the second liquid-supply determining means each correspond to the CPU 411 and the memory 412. The switching-control means corresponds to the CPU 411, the memory 412, and the communications circuitry 418. The flowpath-control means corresponds to the CPU 411, the memory 412, and the communications circuitry 418. Corresponding respectively are: the replacement-complete-information acquisition means to the CPU 411, the memory 412, and the communications circuitry 418; and the connection-commencement-information acquisition means to the CPU 411, the memory 412, and the communications circuitry 418.

Corresponding respectively are: the delivery conduits to the first connecting tubes 23-1 and 23-2; the discharge conduits to the second connecting tubes 25-1 and 25-2; and the pressure-supply conduits to the pressure-supply tubes 71-1 and 71-2. The liquid corresponds to beer.

BRIEF DESCRIPTION OF THE DRAWINGS

FIG. 7 is a chart indicating relationships between states in the beer delivery system 1 and states of respective cutoff devices.

FIG. 14 is a chart indicating relationships between states in the beer delivery system 51, and states of respective cutoff devices and respective pressure-switching devices.

FIG. 16 is a chart indicating relationships between states in a beer delivery system of Embodiment Example 3 and states of respective cutoff devices.

FIG. 18 is a chart indicating relationships between states in a beer delivery system of Embodiment Example 4, and states of respective cutoff devices and respective pressure-switching devices.

FIG. 20 is a chart indicating relationships between states in a beer delivery system of Embodiment Example 5 of a liquid delivery system involving the present invention, and states of respective cutoff devices.

FIG. 22 is a chart indicating relationships between states in a beer delivery system of Embodiment Example 6 of a liquid delivery system involving the present invention, and states of respective cutoff devices and respective pressure-switching devices.

MODES FOR EMBODYING INVENTION

Figure 1:
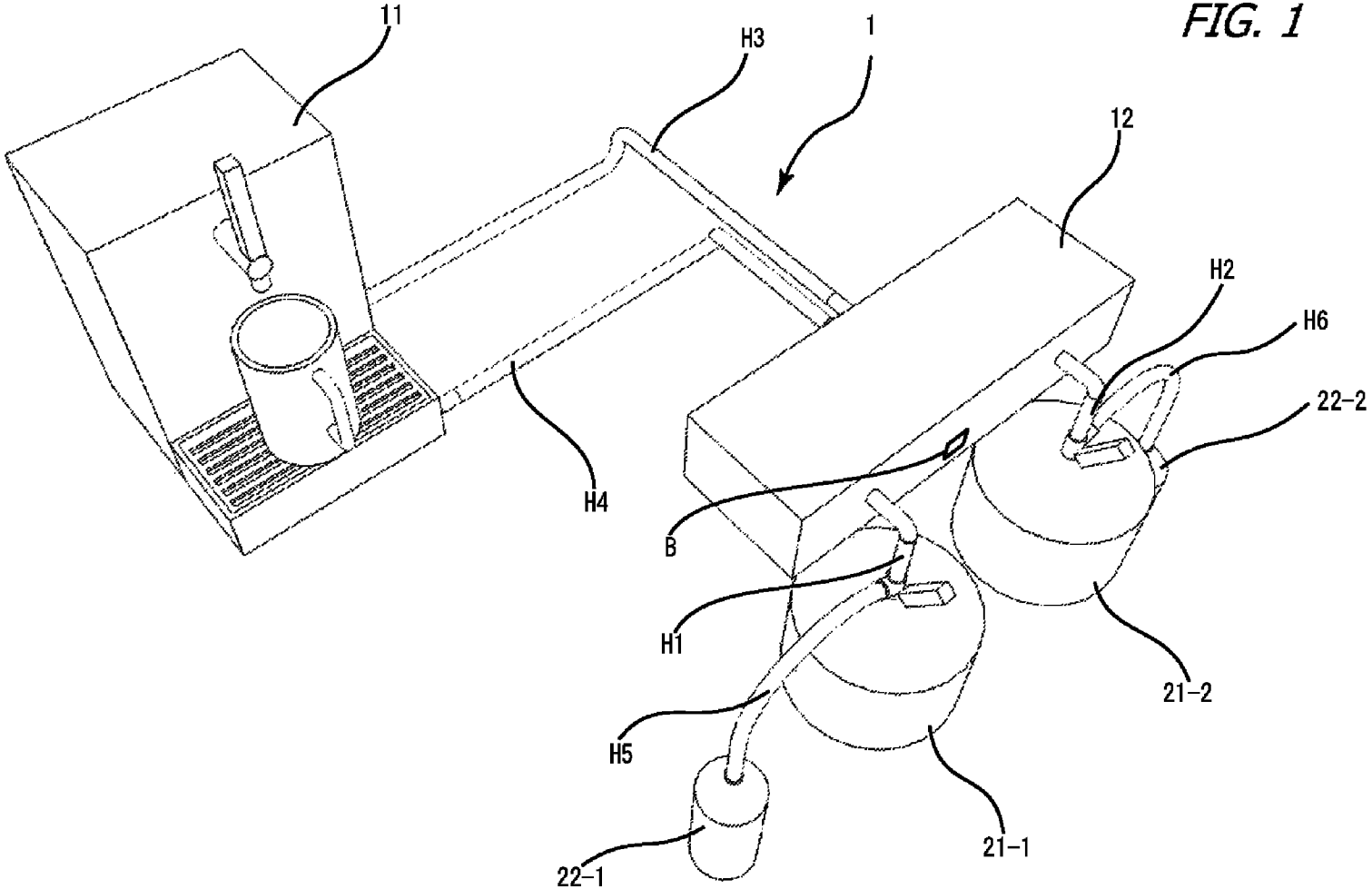
FIG. 1 is a configuration diagram of a beer delivery system 1 in Embodiment Example 1 of a liquid delivery system involving the present invention.

Below, a detailed explanation of embodiment examples of the present invention is set forth while referring to the drawings.

Embodiment Example 1

Part 1: Configuration of Liquid Delivery System

An explanation of the configuration of a beer delivery system that is one mode of embodying a liquid delivery system involving the present invention will be made using FIG. 1. The beer delivery system 1 includes: a dispenser 11; a beer storage-keg switching device 12; beer storage kegs 21-1 and 21-2; beer storage-keg connection tubes H1, H2; a dispenser connection tube H3; and a waste-liquid connection tube H4. It should be noted that in FIG. 1, depiction of beer detection sensors 35-1, 35-2 and 39, to be described later, has been omitted.

The beer storage-keg switching device 12 is connected with the beer storage keg 21-1 via beer storage-keg connection tube H1, and with the beer storage keg 21-2 via beer storage-keg connection tube H2, respectively. The beer storage-keg switching device 12 is also connected with the dispenser 11 via the dispenser connection tube H3 and the waste-liquid connection tube H4. The beer storage-keg switching device 12 has a beer storage-keg replacement button B that is operated by a user when replacement of beer storage kegs has concluded.

Via the beer storage-keg switching device 12, the dispenser 11 dispenses, into an externally situated beer mug or the like, beer that the first beer storage keg 21-1 or the second beer storage keg 21-2 stores. The beer storage-keg switching device 12 switches the beer storage keg that delivers beer between either the beer storage keg 21-1 or the beer storage keg 21-2.

The beer storage keg 21-1 and the beer storage keg 21-2 each store and preserve beer. Here, the beer storage keg 21-1 is connected to a carbon-dioxide tank 22-1 via a tank-connection tube H5. And the beer storage keg 21-2 is connected to a carbon-dioxide tank 22-2 via a tank-connection tube H6. The beer stored in the beer storage keg 21-1 is delivered to the dispenser 11 by means of the pressure from the carbon-dioxide tank 22-1. The situation is likewise with beer storage keg 21-2 and carbon-dioxide tank 22-2.

Part 2: Beer Storage-Keg Switching Device

Using the schematic diagram presented in FIG. 2, an explanation of the internal structure of the beer storage-keg switching device 12 will be made. The beer storage-keg switching device 12 has a first beer-delivery network section 13 that delivers the beer stored in the beer storage keg 21-1, and a second beer delivery network section 15 that delivers the beer stored in the beer storage keg 21-2. The first beer-delivery network section 13 includes a first connection tube 23-1 and a second connection tube 25-1. The second beer-delivery network section 15 includes a first connection tube 23-2 and a second connection tube 25-2.

The first connection tube 23-1 has a joint J1 partway along the tube. The first connection tube 23-1 and the second connection tube 25-1 are connected through the joint J1. The first connection tube 23-1, via a joint J5, is connected with a beer storage-keg connection tube H1 located on the exterior of the beer storage-keg switching device 12. The configuration is likewise with the first connection tube 23-2 and the second connection tube 25-2.

Furthermore, the first connection tube 23-1 and the first connection tube 23-2 are connected by a joint J3. The joint J3 is connected with a dispenser connection tube H3 along the exterior of the beer storage-keg switching device 12. In addition, the second connection tube 25-1 and the second connection tube 25-2 are connected by a joint J4. The joint J4 is connected with a waste-liquid connection tube H4 along the exterior of the beer storage-keg switching device 12. In this way, the beer storage-keg switching device 12 connects the beer storage kegs 21-1 and 21-2 each with the dispenser 11, constituting delivery flowpaths from each of the beer storage kegs 21-1 and 21-2 to the dispenser 11.

The first connection tube 23-1 has, midway along it, a loop section curved into a looped formation. The first connection tube 23-1 includes a (later-described) liquid cutoff device 31-1 containing the loop section. A delivery-enabled state, in which beer can be delivered to the dispenser 11 via the first connection tube 23-1, and a delivery-disabled state, in which beer cannot be delivered to the dispenser 11 via the first connection tube 23-1, are alternated by the liquid cutoff device 31-1.

The second connection tube 25-1 branches from the first connection tube 23-1 at the joint J1. Further, the second connection tube 25-1 is connected via the joint J4 and the waste-liquid connection tube H4 to a waste-liquid receptacle WP on the dispenser 11. In this way, the beer storage-keg switching device 12 connects the beer storage kegs 21-1 and 21-2 each with the waste-liquid receptacle WP, constituting discharge flowpaths from each of the beer storage kegs 21-1 and 21-2 to the waste-liquid receptacle WP.

The second connection tube 25-1 has, midway along it, a loop section curved into a looped formation. The second connection tube 25-1 includes a (later-described) liquid cutoff device 33-1 containing the loop section. A delivery-enabled state, in which beer can be delivered to the waste-liquid receptacle WP via the second connection tube 25-1, and a delivery-disabled state, in which beer cannot be delivered to the waste-liquid receptacle WP via the second connection tube 25-1, are alternated by the liquid cutoff device 33-1.

The (later-described) beer-detection sensor 35-1 detects the delivery status of beer in the beer storage-keg connection tube H1, in the area where the beer-detection sensor 35-1 is installed. It will be appreciated that the beer-detection sensor 35-1 preferably is disposed in a location near the beer storage keg 21-1 with the beer storage-keg connection tube H1. That way, by disposing the beer-detection sensor 35-1 in a location near the beer storage keg 21-1, the delivery status of beer in the beer storage-keg connection tube H1 can be quickly detected.

The (later-described) beer-detection sensor 39 detects the delivery status of beer in the area of the waste-liquid connection tube H4 where the sensor is installed. The beer-detection sensor 39 preferably is disposed in a location near the where waste-liquid connection tube H4 connects with the beer storage-keg switching device 12. That way, by disposing the beer-detection sensor 39 in a location near the beer storage-keg switching device 12, the amount of beer present from the joint J1 to the beer-detection sensor 39 that in the end unavoidably must be disposed of as waste liquid can be minimized.

It should be understood that because the second beer-delivery network section 15 is similar to the first beer-delivery network section 13, description thereof is omitted.

The liquid cutoff devices 31-1, 33-1, 31-2 and 33-2, and the beer-detection sensors 35-1, 35-2 and 39 are connected by respective connection lines to a (later-described) control computer 41. The control computer 41, utilizing numerical values from the beer-detection sensors, controls the operation of the liquid cutoff devices.

Part 3: Liquid Cutoff Devices

Using FIG. 3, an explanation of the structural outline of the liquid cutoff devices 31-1, 33-1, 31-2 and 33-2 will be made. It should be noted that in the following, liquid cutoff device 31-1 will be described; because the other liquid cutoff devices are similar to liquid cutoff device 31-1, detailed description thereof is omitted.

Figure 3A:
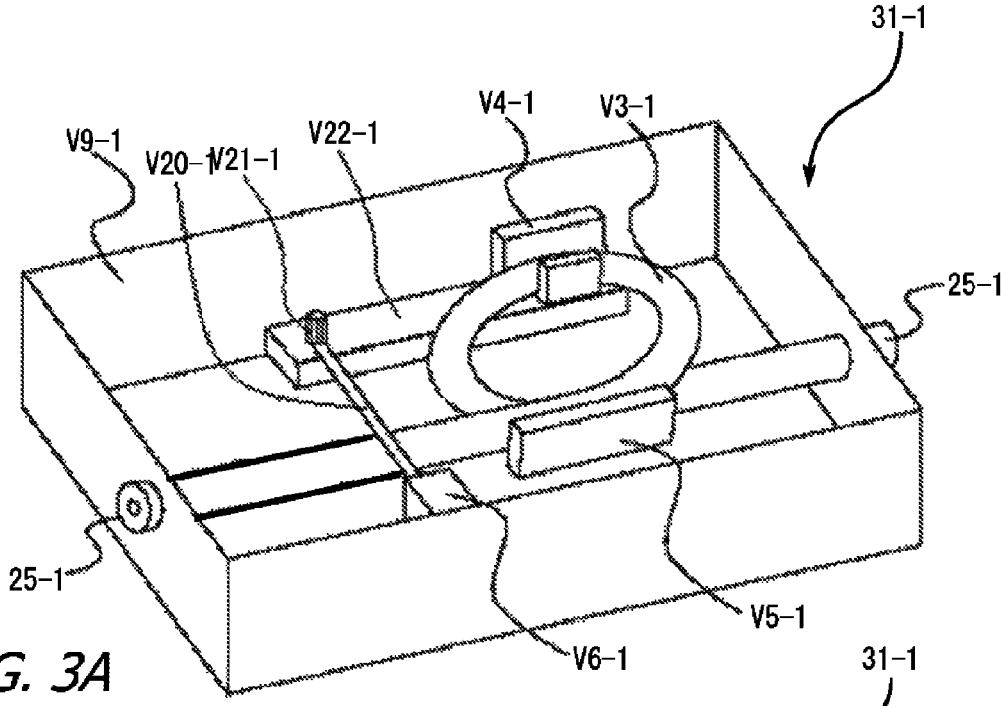
FIG. 3 is a diagram illustrating the configuration of a liquid cutoff device.
Figure 3B:
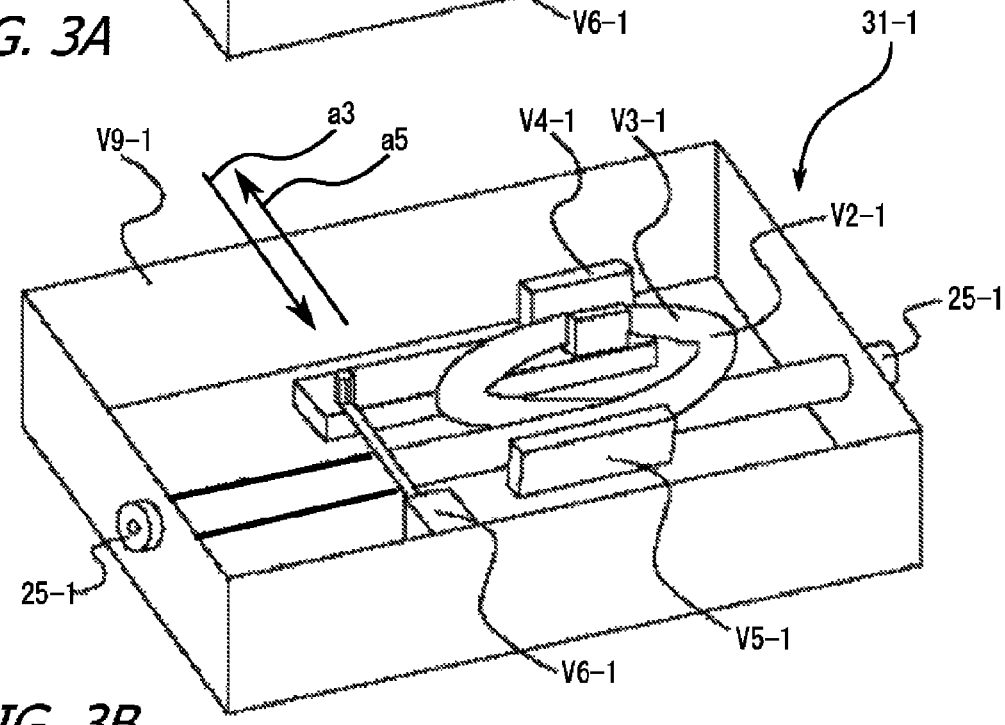

In FIG. 3, a situation in which the upper cover of a unit case V9-1 for the liquid cutoff device 31-1 has been taken off is depicted. A state in which the liquid cutoff device 31-1 is not operating is represented in FIG. 3A, while a state in which it is operating is represented in FIG. 3B. As illustrated in FIG. 3A, the liquid cutoff device 31-1 includes, inside the unit case V9-1, a tube support part V5-1, a movable part V4-1, an electromotor V6-1, a coupling V20-1, a fastener V21-1, and a movable stage V22-1.

The movable part V4-1 clamps the outer form of a loop section V3-1 of the first connection tube 23-1. The tube support part V5-1, in a location opposing the movable part V4-1, supports the first connection tube 23-1, and prevents the loop section V3-1 from shifting in conjunction with the movement of the movable part V4-1 with the loop-formation outer form being sustained as it is. The electromotor V6-1 drives the movable part V4-1. The coupling V20-1 connects the electromotor V6-1 and the movable stage V22-1. The fastener V21-1 joins the coupling V20-1 and the movable stage V22-2. The operation of the electromotor V-6-1 is controlled by the control computer 41.

As illustrated in FIG. 3B, the electromotor V6-1, following commands from the control computer 41, actuates the coupling V20-1 in the direction of the arrow a3. Via the fastener V21-1, the movable stage V22-1 thereby also operates in the direction of the arrow a3—that is, heading toward the tube support part V5-1. As a result, the movable part V4-1 draws toward the tube support part V5-1, crimping the loop section V3-1 of the first connection tube 23-1. This causes a kink V2-1 bending the first connection tube 23-1 to occur.

In this way, the liquid cutoff device 31-1, by the movable part V4-1 pushing the loop section V3-1 of the first connection tube 23-1 in the direction of the arrow a3, produces the kink V2-1 in the first connection tube 23-1, and as a result interrupts the flowing of beer inside the first connection tube 23-1. Likewise, the liquid cutoff device 31-1, by the movable part V4-1 pulling back in the direction of the arrow a5, undoes the kink V2-1, forming the original loop section V3-1 in the first connection tube 23-1 and making it so that beer again flows inside the first connection tube 23-1.

It should be noted that the liquid cutoff devices 31-1, 33-1, 31-2 and 33-2 are machines utilizing the technology in Japanese Unexamined Pat. Pub. 2008-256096.

Utilizing the liquid cutoff device 31-1 eliminates the necessity of arranging, along the way of the first connection tube 23-1, conventional valves, such as electromagnetic valves, having structural components that come into contact directly with the beer. Accordingly, sponges and other washing implements getting caught in valves is not an issue, such that a washing implement can be utilized to wash the inner wall of the first connection tube 23-1. Facilitated performance of hygiene management in supplying beer and other beverage substances is thus made possible.

Furthermore, the liquid cutoff device 31-1 has no structural components that come into contact directly with the beer. Thus, there is no negative impact on the system operation that would arise owing to constituents of the beer, etc. clinging to the structural components. That is, the necessity, as with conventional valves, of performing a dismantle-washing or other such job of periodically washing structural components is eliminated. What is more, the mixing-in of foreign matter due to friction, damage, etc. associated with the operation of structural components can be averted. Performing hygiene management with ease in supplying beer and other beverage substances is accordingly possible. Further, since there is no clinging of constituents of the beer, etc. to structural components, the propagation, which would owe to that factor, of germs and the like does not arise. For these reasons, utilizing the cutoff device 31-1 makes it possible easily to keep the beer delivery system in a favorable hygienic condition. In short, hygiene management of, and operation assurances in, the beer delivery system 1 can be performed with ease.

It will be appreciated that the situation is likewise with the liquid cutoff devices 33-1, 31-2 and 33-2.

Part 4: Beer Detection Sensors

Using FIG. 4, an outline of beer detection sensors 35-1, 35-2 and 39 will be described. In the following, beer detection sensor 35-1 will be explained; description of the other beer detection sensors is omitted.

Figure 4A:
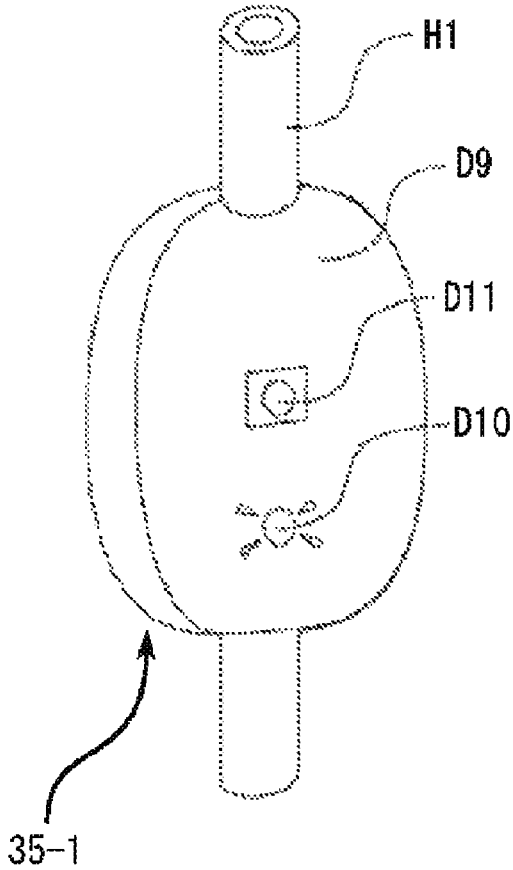
FIG. 4 is an oblique perspective view of a beer detection sensor.
Figure 4B:
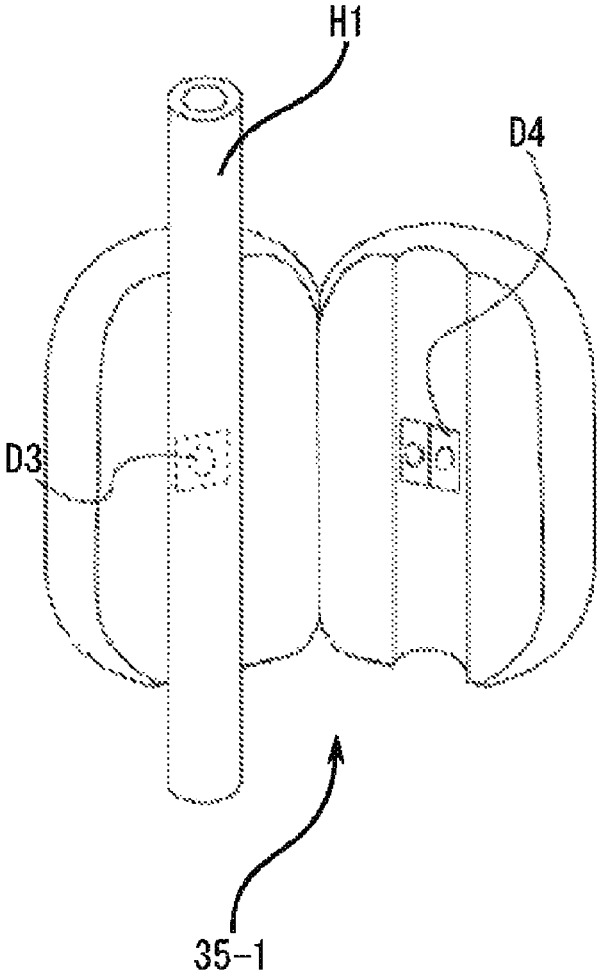

An oblique perspective view of the beer detection sensor 35-1 is represented in FIG. 4. FIG. 4A illustrates a state in which a housing D9 is shut, fitted onto the beer storage-keg connection tube H1, while FIG. 4B illustrates a state in which the housing D9 is opened. As indicated in FIG. 4A, a light-emitting circuit element D10 and a switch D11 are incorporated into the outer face of the housing D9. As indicated in FIG. 4B, a beam-projecting circuit element D3 and a beam-receiving circuit element D4 are incorporated into the interior of the housing D9. With the housing D9 shut, the beam-projecting element D3 and the beam-receiving element D4 are disposed in opposition, sandwiching the beer storage-keg connection tube H1. The beam-projecting element D3 radiates an infrared beam, while the beam-receiving element D4 optically receives infrared beams.

Figure 5A:
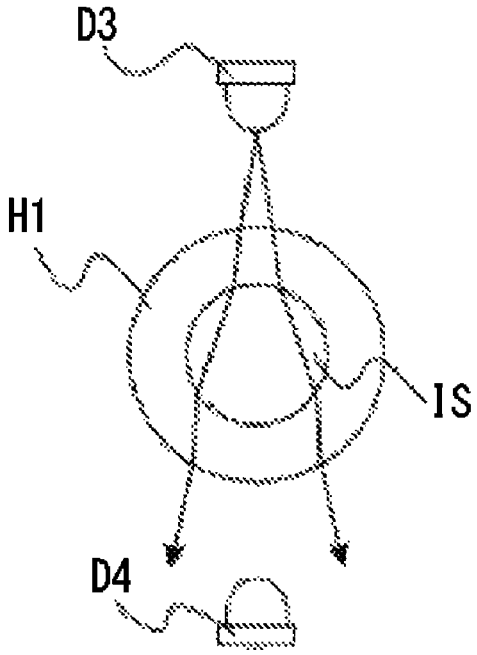
FIG. 5 is a diagram for explaining principles of the beer detection sensor.
Figure 5B:
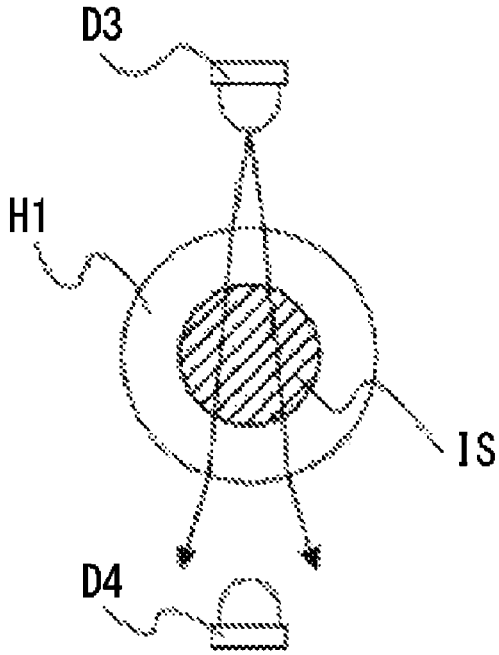

Using FIG. 5, an explanation of the interrelationship between the infrared beam that the beam-projecting element D3 shines and the status of the delivery of beer in the beer storage-keg connection tube H1 will be made. FIG. 5A represents a state (State A) in which the interior space IS in the beer storage-keg connection tube H1 is a gas such as air, while FIG. 5B represents a state (State B) in which the interior space IS in the beer storage-keg connection tube H1 is a liquid such as water. As indicated in FIGS. 5A and B, in the State A case, the infrared beam shone from the beam-projecting element D3 is dispersed by comparison with the State B case. Thus, the amount of received light in the infrared beam that the beam-receiving element D4 optically receives in State A, compared with the amount of received light in the infrared beam that the beam-receiving element D4 optically receives in State B, will be relatively smaller. This is due to the difference in refractive indices between a gas and a liquid.

And in a situation in which air bubbles are generated within the beer or other liquid that passes through the interior of the beer storage-keg connection tube H1, a state in which the interior of the beer storage-keg connection tube H1 is liquid and a state in which it is gaseous will be mixed together, and moreover will alternate vigorously. For that reason the amount of received light that the beam-receiving element D4 optically receives will vary intensely. Analyzing the variation in the received-light quantity makes it possible the more reliably to comprehend the status of air-bubble generation.

The variation thus in the received-light quantity in the beam-receiving element D4 determines the beer-delivery status, by an optical reception signal from the beam-receiving element D4 being acquired, and the data being processed, in the control computer 41.

It should be noted that the beer detection sensors 35-1, 35-2 and 39 are devices utilizing the technology in Japanese Unexamined Pat. Pub. 2008-180643.

Part 5: Control Computer

1. Hardware Configuration

Figure 6:
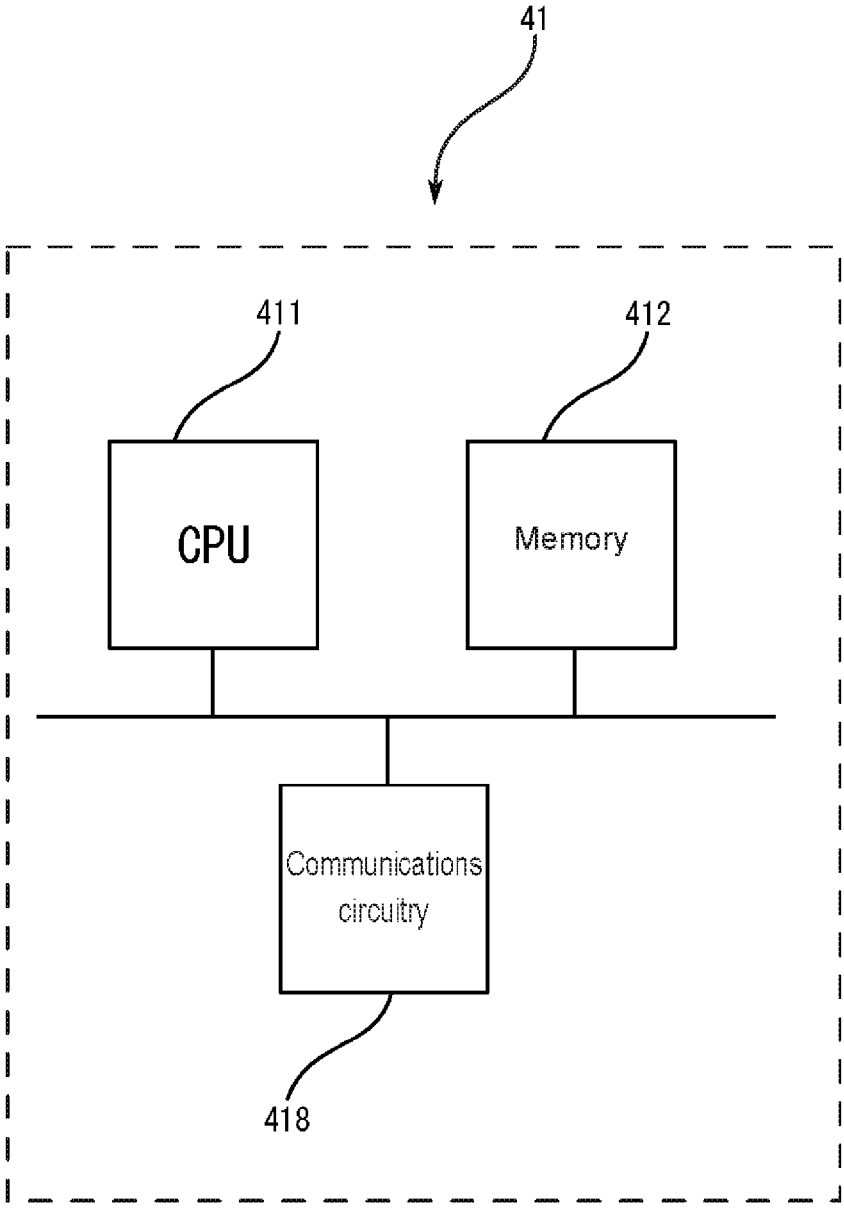
FIG. 6 is a diagram representing the hardware configuration of a control computer 41.

The configuration of the control computer 41 hardware is represented in FIG. 6. The control computer 41 includes a CPU 411, a memory 412, and a communications circuitry 418.

The CPU 411 carries out processes based on a beer delivery program recorded in the memory 412. The memory 412 provides the CPU 411 with a working area. The memory 412 also records/holds data other than the beer delivery program.

The communications circuitry 418 has a communications circuit connected to a network, and is connected with, to carry out predetermined data transmission/reception with, the liquid cutoff devices 31-1, 33-1, 31-2 and 33-2, and the beer-detection sensors 35-1, 35-2 and 39.

2. Control Outline

The control computer 41, in accordance with beer-delivery status it determines based on data obtained from the beer-detection sensors 35-1, 35-2 and 39, controls the operation of the liquid cutoff devices 31-1, 33-1, 31-2 and 33-2. This enables switching in alternation between the beer storage keg 21-1 and beer storage keg 21-2 to be carried out smoothly.

Using FIG. 7, an outline of operational control in the control computer 41 with respect to the liquid cutoff devices 31-1, 33-1, 31-2 and 33-2 will be made.

Supposed herein is an instance of switching from a state in which beer is delivered to the dispenser 11 from the first beer-delivery network section 13 (State 1), to a state in which it is delivered to the dispenser 11 from the second beer-delivery network section 15 (State 2), and of thereafter rendering a state of preparing so that beer may be delivered anew from the first beer-delivery network section 13 (State 3).

In State 1, in which beer is delivered through the first beer-delivery network section 13, it is necessary that the beer stored in the beer storage keg 21-1 be delivered to the dispenser 11 via the first connection tube 23-1. Accordingly, liquid cutoff device 31-1 alone is put into the delivery-enabled state, while the other liquid cutoff devices are put into the delivery-disabled state.

After that, when the beer stored in the beer storage keg 21-1 runs out and State 2, in which beer is supplied from the other beer storage keg 21-2, is switched into, it is necessary to halt the delivery of beer to the dispenser 11 from the beer storage keg 21-1, made via the first connection tube 23-1, and begin delivery of beer to the dispenser 11 from the beer storage keg 21-2, made via the first connection tube 23-2. Accordingly, liquid cutoff device 31-1 is put into the delivery-disabled state and liquid cutoff device 31-2 is put into the delivery-enabled state, with the other liquid cutoff devices being put into the delivery-disabled state.

Furthermore, the beer storage keg 21-1 is exchanged for a fresh keg and from the substitute beer storage keg 21-1 bubbles are discharged through the second connection tube 25-1, putting the system into State 3 in which it is readied so that beer may be delivered from the substitute beer storage keg 21-1. Then, when the discharging of bubbles is finished, the system cycles back to State 1, so that beer will not be discharged from the second connection tube 25-1.

To begin with, the beer storage keg 21-1 is exchanged for a fresh keg, and the beer storage-keg connection tube H1 is connected to the substitute beer storage keg 21-1. Usually, at the outset of delivery of beer from a beer storage keg, rather than beer as a liquid flowing out, foam streams out. On that account, in commencing the delivery of beer from a fresh beer storage keg, it is necessary at first to carry out a foam-clearing task.

Therein, after the fresh beer storage keg 21-1 and the beer storage-keg connection tube H1 have been connected, discharging of foam from the beer storage keg 21-1 into the waste-liquid receptacle WP, done via the second connection tube 25-1, is begun. Accordingly, in State 3, liquid cutoff device 33-1 is put into the delivery-enabled state, and liquid cutoff device 31-1 is put into the delivery-disabled state. It should be understood that in the present embodying mode, exchanging of the beer storage kegs 21-1 is carried out in parallel with delivery of beer from the beer storage keg 21-2, entailing that the liquid cutoff device 31-2 be put into the delivery-enabled state, and the liquid cutoff device 33-2 be put into the delivery-disabled state.

Then, when the discharging of foam finishes, it is necessary that the beer not be discharged via the second connection tube 25-1 into the waste-liquid receptacle WP. The discharging of foam from the fresh beer storage keg 21-1 concludes when a predetermined period of time has elapsed. Accordingly, following elapse of the predetermined time period, the liquid cutoff device 33-1 is put into the delivery-disabled state. This ends the discharging of beer via the second connection tube 25-1 into the waste-liquid receptacle WP. The system state at that point corresponds to the situation where, in earlier described State 1, beer is delivered from the beer storage keg 21-2.

Thereafter, with regard to storage keg 21-2, determination of State 1 through State 3 is made to control the operation of the liquid cutoff devices 31-1, 33-1, 31-2 and 33-2.

Actuating the liquid cutoff devices 31-1, 31-2, 33-1 and 33-2 in response to this manner of change of state makes it possible to be able always to deliver beer, from the one of the beer storage kegs to the other of the beer storage kegs, without interruption.

3. Operation of Control Computer

Using the flowchart presented in FIG. 8, an explanation of the operation of the earlier-described CPU 411 of the control computer 41 will be made. Here, with regard to the following operation of the CPU 411, an instance in which beer is delivered from the beer storage keg 21-1 in an initial state, and thereafter the operational state is changed from State 1→State 2→State 3 will be explained. Inasmuch as the situation where beer is delivered from beer storage keg 21-2 in the initial state is similar to the situation where beer is delivered from beer storage keg 21-1, description thereof is omitted.

Figure 9:
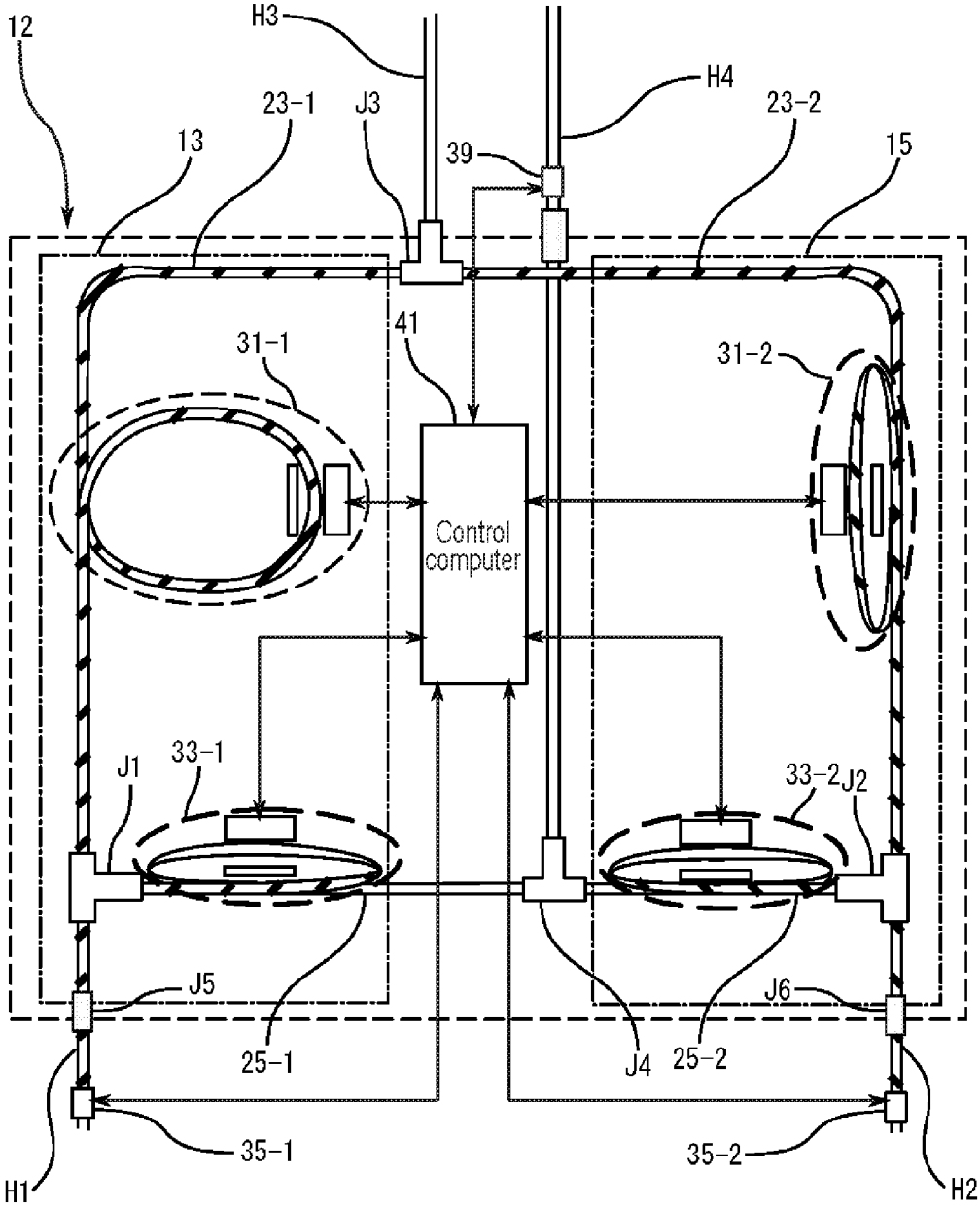
FIG. 9 is a diagram illustrating State 1 in the beer delivery system 1.

As indicated in FIG. 9, in State 1, in the situation where beer is delivered from the beer storage keg 21-1, the beer storage-keg connection tube H1, the first connection tube 23-1 from joint J5 to joint J3, and the dispenser connection tube H3 are filled with beer that the beer storage keg 21-1 has supplied. Further, the second connection tube 25-1, in the range from joint J1 to the liquid cutoff device 33-1, is also filled with beer that the beer storage keg 21-1 supplies. In addition, the first connection tube 23-2, in the range from joint J3 to the liquid cutoff device 31-2, is filled with beer that the beer storage keg 21-1 has supplied.

Let it be assumed, meanwhile, that preparation for beer delivery of the beer storage keg 21-2, furnished in situations where the delivery of beer from the beer storage keg 21-1 has concluded, has already been completed. In that case, the beer storage-keg connection tube H2, the first connection tube 23-2 from joint J6 to liquid cutoff device 31-2, and the second connection tube 25-2 from joint J2 to liquid cutoff device 33-2 are filled with beer that the beer storage keg 21-2 has supplied.

Figure 8:
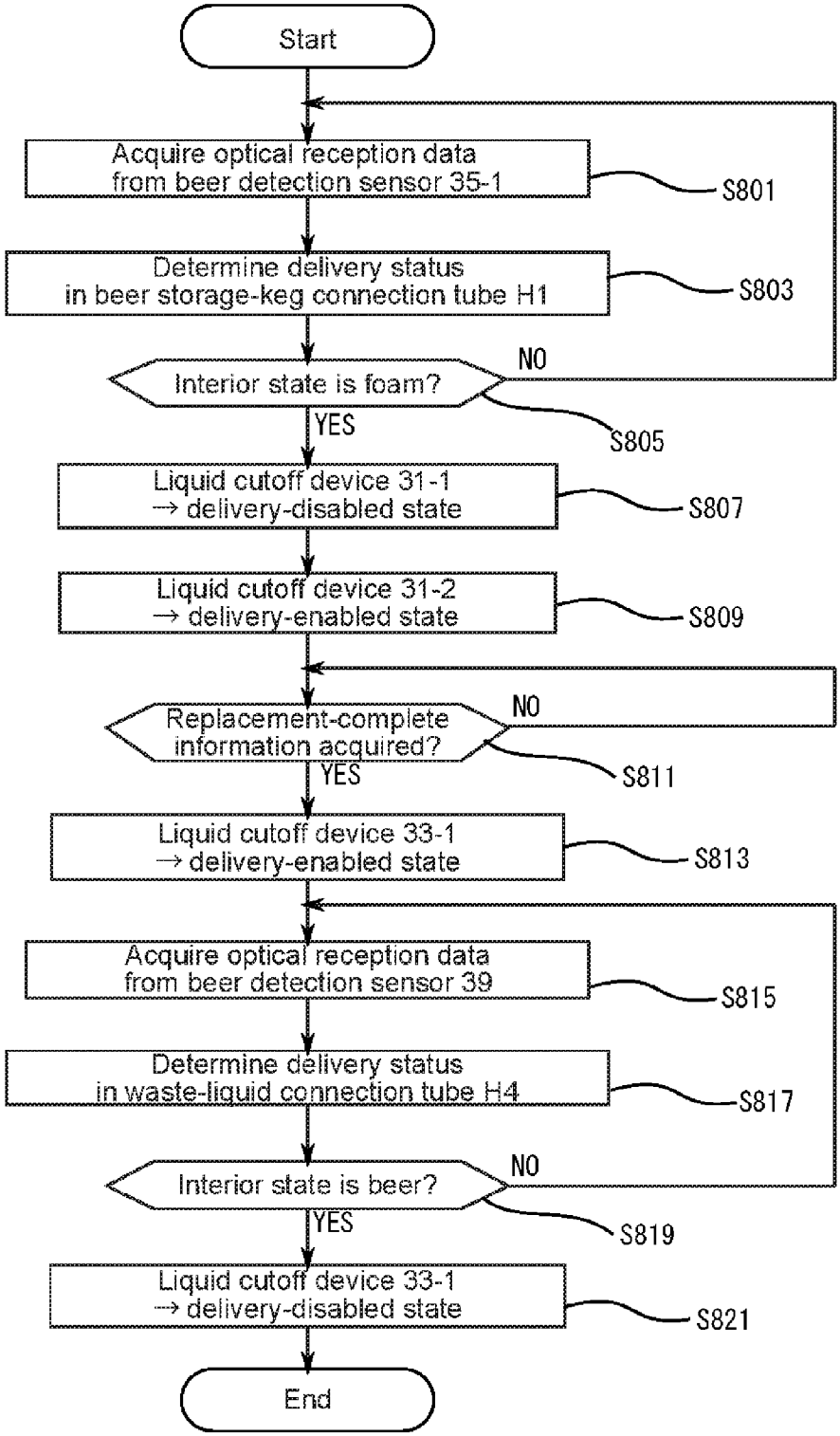
FIG. 8 is a flowchart indicating operations in the CPU 411.

In the situation thus, as indicated in FIG. 8, the CPU 411 acquires optical reception data indicating the amount of infrared light received from the beer-detection sensor 35-1 (S801). The CPU 411 determines, based on the acquired optical reception data, the delivery status of beer in the beer storage-keg connection tube H1, which is provided with the beer-detection sensor 35-1 (S803). The beer-detection sensor 35-1 is provided in the vicinity of where the beer storage keg 21-1 and the beer storage-keg connection tube H1 connect. The beer-detection sensor 35-1 is therefore able most rapidly to detect the delivery status of beer from the beer storage keg 21-1.

When the CPU 411 determines, based on the optical reception data from the beer-detection sensor 35-1, that the bubbles have gone out of the beer storage keg 21-1 (S805), it determines that delivery of beer from the beer storage keg 21-1 has concluded, and operates the liquid cutoff device 31-1 to put the device into the delivery-disabled state (S807). In addition, the CPU 411 operates the liquid cutoff device 31-2 to put it into the delivery-enabled state (S809). This enables, in the supplying of beer, changing from the beer storage keg 21-1 over to the beer storage keg 21-2 without the delivery of beer ceasing.

Figure 10:
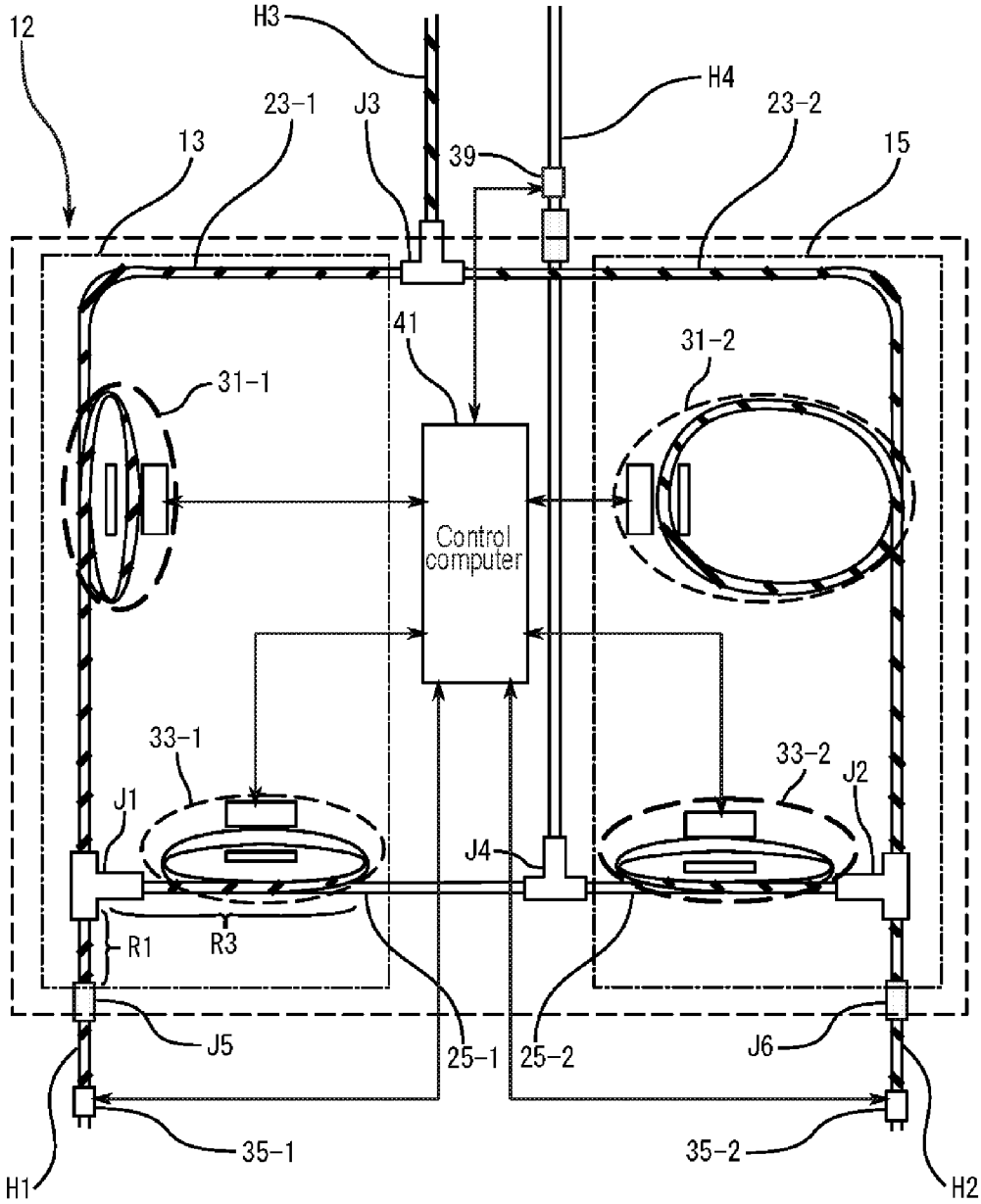
FIG. 10 is a diagram illustrating State 2 in the beer delivery system 1.

As indicated in FIG. 10, in State 2, beer is delivered from the beer storage keg 21-2, whereby the beer storage-keg connection tube H2, the first connection tube 23-2 from joint J6 to joint J3, and the dispenser connection tube H3 are filled with beer that the beer storage keg 21-2 has supplied.

Herein, the user of the beer delivery system 1 detaches the beer storage keg 21-1 connected to the beer storage-keg connection tube H1 and connects a freshly readied beer storage keg 21-1 with the beer storage-keg connection tube H1 to complete an exchange of beer storage kegs 21-1. When the user completes the exchange of beer storage kegs 21-1, he or she presses the beer storage-keg replacement button B provided on the beer storage-keg switching device 12.

As indicated in FIG. 8, when the CPU 411 acquires replacement-complete information from the beer storage-keg replacement button B (S811), it operates the liquid cutoff device 33-1 to put it into the delivery-enabled state (S813). Bubbles delivered from the beer storage keg 21-1 in the initial stage following the beer storage-keg exchange are thereby discharged to the waste-liquid receptacle WP in the dispenser 11.

In the initial stage when the liquid cutoff device 33-1 is operated to discharge bubbles, beer present in the region R1 of the first connection tube 23-1 from joint J5 to joint J1 and beer present in the region R3 of the second connection tube 25-1 from joint J1 to liquid cutoff device 33-1 is discharged as waste fluid into the waste-liquid receptacle WP. Accordingly, it is preferable that the liquid cutoff device 33-1 be disposed in a location near, to the extent possible, joint J1. This makes it possible to minimize the amount of beer that unavoidably must be disposed of as waste fluid in the initial stage.

Figure 11:
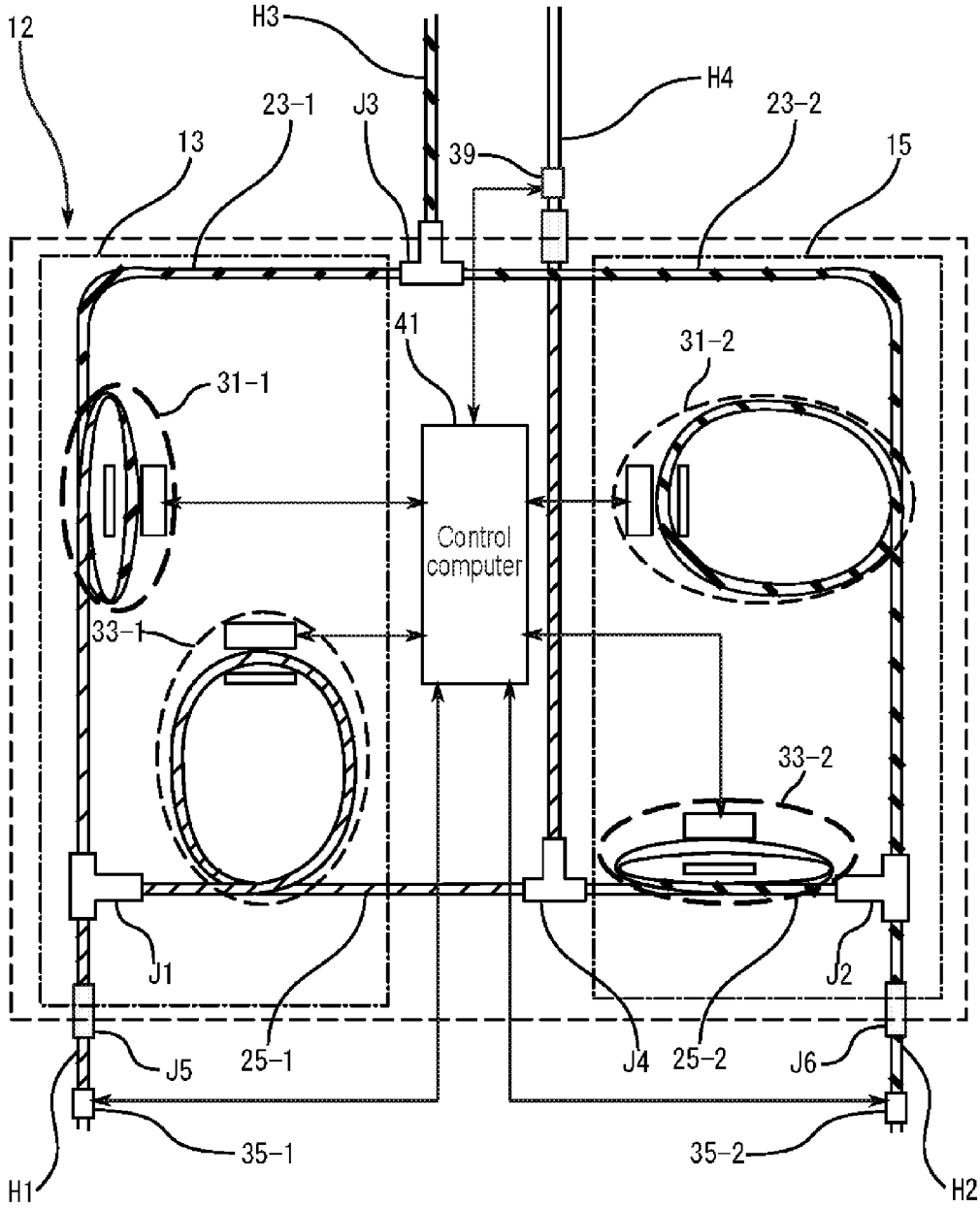
FIG. 11 is a diagram illustrating State 3 in the beer delivery system 1.

After that, in State 3, as indicated in FIG. 11, the beer storage-keg connection tube H1, the second connection tube 25-1, and the waste-liquid connection tube H4 are filled with foam, owing to bubbles that come from the beer storage keg 21-1.

As indicated in FIG. 8, the CPU 411 acquires from the beer-detection sensor 39 optical reception data indicating the amount of infrared light received (S815). The CPU 411 determines, based on the acquired optical reception data, the delivery status of beer in the waste-liquid connection tube H4, which is provided with the beer-detection sensor 39 (S817). When the CPU 411 determines, based on the optical reception data from the beer-detection sensor 39, that in the location where this beer-detection sensor 39 is disposed, beer rather than foam is flowing (S819), it operates the liquid cutoff device 33-1 to put the device into the delivery-disabled state (S821).

From joint J1 to beer-detection sensor 39 as indicated in FIG. 11 thereby becomes filled with beer that is supplied from the beer storage keg 21-1. In this way, after the liquid cutoff device 33-1 has been put into the delivery-disabled state, the beer present in the interval from joint J1 to the beer-detection sensor 39 must unavoidably be disposed of as waste fluid ultimately. Accordingly, it is preferable that the beer-detection sensor 39 be disposed in a location near, to the extent possible, the liquid cutoff device 33-1. This makes it possible to minimize the amount of beer that in the end must unavoidably be disposed of as waste fluid.

It should be understood that the state in which the liquid cutoff device 33-1 has been rendered delivery-disabled is the same as that in which, in FIG. 9, the beer storage keg that supplies beer is changed over from the beer storage keg 21-1 to the beer storage keg 21-2.

Embodiment Example 2

In the beer-delivery system 1 involving aforedescribed Embodiment Example 1, employing carbon dioxide tanks 22-1 and 22-2, connected respectively to the beer storage kegs 21-1 and 21-2, to deliver the beer stored therein was adopted. In the beer delivery system 51 involving the present embodiment example, meanwhile, the stored beer is delivered by controlling the pressure supplied from the carbon dioxide tanks connected to the two beer storage kegs 21-1 and 21-2. It should be noted that in the following, configurational structures that are the same as those of Embodiment Example 1 are labeled with the same reference marks. Furthermore, detailed description of configurational structures that are the same as those of Embodiment Example 1 are omitted.

Part 1: Configuration of Liquid Delivery System

An explanation of the configuration of a beer delivery system that is one embodying mode of a liquid delivery system involving the present invention will be made using FIG. 12. The beer delivery system 51 includes: a dispenser 11; a beer storage-keg switching device 52; beer storage kegs 21-1 and 21-2; beer storage-keg connection tubes H1 and H2; a dispenser connection tube H3; a waste-liquid connection tube H4; a carbon dioxide tank 72; beer-storage-keg tank-connection tubes H51 and H52; and a tank connection tube H53. It should be noted that, likewise as with Embodiment Example 1, depiction of beer detection sensors 35-1, 35-2 and 39 is omitted.

The carbon dioxide tank 72 supplies pressure to the beer storage keg 21-1. Via the tank connection tube H53, the carbon dioxide tank 72 is connected to the beer storage-keg switching device 52. The carbon dioxide tank 72 has a canister 72*a*, a pressure-regulating valve 72*b*, and a handle 72*c*. Operating the handle 72*c* supplies carbon dioxide, highly pressurized and stored inside the canister 72*a*, to the beer-storage-keg tank-connection tube H53. The carbon dioxide supplied from the canister 72*a* to the tank-connection tube H53 is regulated to an appropriate pressure by means of the pressure-regulating valve 72*b* so as to let beer be delivered suitably from the dispenser 11.

Beer storage keg 21-1 is connected to the beer storage-keg switching device 52 via beer-storage-keg tank-connection tube H51. Beer storage keg 21-2 is connected to the beer storage-keg switching device 52 via beer-storage-keg tank-connection tube H52.

The internal pressure of the beer storage keg 21-1 is raised by pressure supplied from the carbon dioxide tank 72, delivering the stored beer to the exterior.

Part 2: Beer Storage-Keg Switching Device

Using the schematic diagram presented in FIG. 13, an explanation of the internal structure of the beer storage-keg switching device 52 will be made. Beer storage-keg switching device 52 entirely incorporates the makeup of beer storage-keg switching device 12 illustrated in FIG. 2. In addition, the beer storage-keg switching device 52 has pressure-supply tubes 71-1 and 71-2, and pressure-switching devices 73-1 and 73-2. The pressure-switching devices 73-1 and 73-2 are arranged midway along the respective pressure-supply tubes 71-1 and 71-2.

Pressure-supply tube 71-1 is connected to beer storage keg 21-1 via beer-storage-keg tank-connection tube H51. Likewise, pressure-supply tube 71-2 is connected to beer storage keg 21-2 via beer-storage-keg tank-connection tube H52. The pressure-supply tubes 71-1 and 71-2 are connected by a joint J13. As a result, via the joint J13, the pressure-supply tubes 71-1 and 71-2 are connected to the tank connection tube H53.

Figure 13:
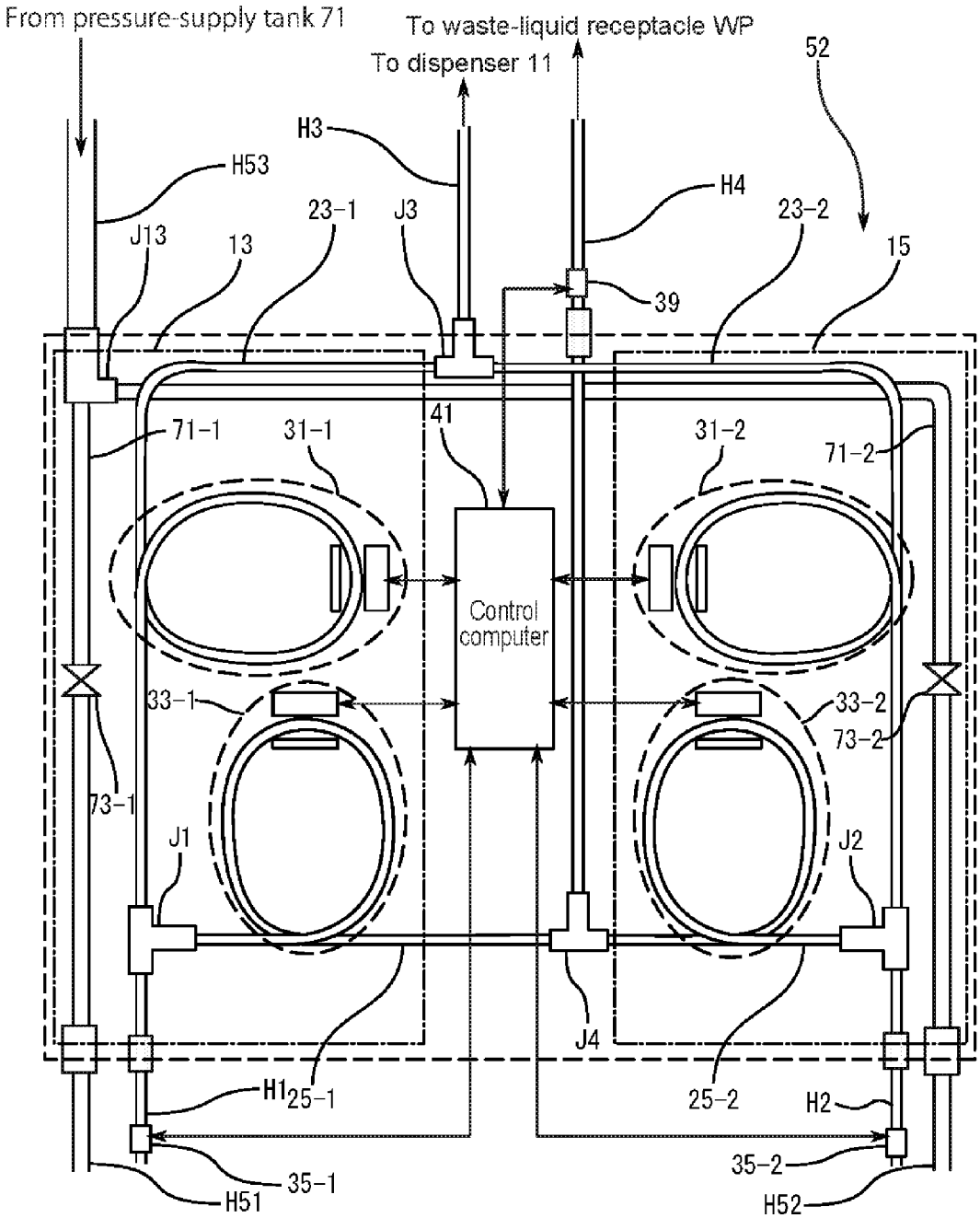
FIG. 13 is a configuration diagram of the beer storage-keg switching device 52 in FIG. 12.

The pressure-switching device 73-1 regulates the pressure supplied to beer storage keg 21-1 via pressure-supply tube 71-1 from a pressure-supply tank 71, illustrated in FIG. 13. The pressure-switching device 73-1 is made up of an electromagnetic valve. That is likewise the case with the pressure-switching device 73-2.

Here, the pressure-switching devices 73-1 and 73-2 are each connected to the control computer 41. Operation of the pressure-switching devices 73-1 and 73-2 is controlled by the control computer 41.

Part 3: Control Computer

1. Control Outline

Using FIG. 14, an explanation of the control computer 41 involving the present embodiment example will be made. The control computer 41, in accordance with beer-delivery status it determines based on data obtained from the beer-detection sensors 35-1, 35-2 and 39, controls the operation of the liquid cutoff devices 31-1, 33-1, 31-2 and 33-2. This enables switching in alternation between the beer storage keg 21-1 and beer storage keg 21-2 to be carried out smoothly.

Supposed herein, likewise as with Embodiment Example 1, is an instance of switching from a state in which the beer is delivered to the dispenser 11 from the first beer-delivery network section 13 (State 1), to a state in which it is delivered to the dispenser 11 from the second beer-delivery network section 15 (State 2), and of thereafter rendering a state of preparing so that beer may be delivered anew from the first beer-delivery network section 13 (State 3).

In State 1, in which beer is delivered through the first beer-delivery network section 13, it is necessary that the beer stored in the beer storage keg 21-1 be delivered to the dispenser 11 via the first connection tube 23-1. Accordingly, as far as the liquid cutoff devices are concerned, liquid cutoff device 31-1 alone is put into the delivery-enabled state, while the other liquid cutoff devices are put into the delivery-disabled state. As far as the pressure-switching devices are concerned, pressure-switching device 73-1 is put into the pressure-supply enabled state so as to let beer be delivered from the beer storage keg 21-1. On the other hand, pressure-switching device 73-2 is put into the pressure-supply disabled state.

After that, when the beer stored in the beer storage keg 21-1 runs out and State 2, in which beer is supplied from the other beer storage keg 21-2, is switched into, it is necessary to halt the delivery of beer to the dispenser 11 from the beer storage keg 21-1, made via the first connection tube 23-1, and begin delivery of beer to the dispenser 11 from the beer storage keg 21-2, made via the first connection tube 23-2. Accordingly, as far as the liquid cutoff devices are concerned, liquid cutoff device 31-1 is put into the delivery-disabled state and liquid cutoff device 31-2 is put into the delivery-enabled state, with the other liquid cutoff devices being put into the delivery-disabled state. As far as the pressure-switching devices are concerned, pressure-switching device 73-2 is put into the pressure-supply enabled state so as to let beer be delivered from the beer storage keg 21-2. On the other hand, pressure-switching device 73-1 is put into the pressure-supply disabled state. Here, switching the states of pressure-switching device 73-1 and pressure-switching device 73-2 is done roughly simultaneously. Alternatively, after the state of pressure-switching device 73-1 has been switched over, the state of pressure-switching device 73-2 is switched over.

Furthermore, the beer storage keg 21-1 is exchanged for a fresh keg and from the substitute beer storage keg 21-1 bubbles are discharged through the second connection tube 25-1, putting the system into State 3 in which it is readied so that beer may be delivered from the substitute beer storage keg 21-1. Then, when the discharging of bubbles is finished, the system cycles back to State 1, so that beer will not be discharged from the second connection tube 25-1.

To begin with, the beer storage keg 21-1 is exchanged for a fresh keg, and the beer storage-keg connection tube H1 is connected to the substitute beer storage keg 21-1. Usually, at the outset of delivery of beer from a beer storage keg, rather than beer as a liquid flowing out, foam streams out. On that account, in commencing the delivery of beer from a fresh beer storage keg, it is necessary at first to carry out a foam-clearing task.

Therein, after the fresh beer storage keg 21-1 and the beer storage-keg connection tube H1 have been connected, discharging of foam from the beer storage keg 21-1 into the waste-liquid receptacle WP, done via the second connection tube 25-1, is begun. Accordingly, in State 3, liquid cutoff device 33-1 is put into the delivery-enabled state, and liquid cutoff device 31-1 is put into the delivery-disabled state. At that time, owing to the necessity of discharging the foam from the beer storage keg 21-1, the pressure-switching device 73-1 is put into the pressure-supply enabled state. It should be understood that the switching over of the state of the pressure-switching device 73-1 is carried out roughly simultaneously with the switching over of the state of the liquid cutoff device 33-1. Alternatively, after the state of the liquid cutoff device 33-1 has been switched over, the state of the pressure-switching device 73-1 is switched over.

It should be understood that in the present embodying mode, exchanging of the beer storage kegs 21-1 is carried out in parallel with delivery of beer from the beer storage keg 21-2, entailing that the liquid cutoff device 31-2 be put into the delivery-enabled state, and the liquid cutoff device 33-2 be put into the delivery-disabled state. Further, the pressure-switching device 73-2 is put into the pressure-supply enabled state.

Then, when the discharging of foam finishes, it is necessary that the beer in the beer storage keg 21-1 not be discharged via the second connection tube 25-1 into the waste-liquid receptacle WP. The discharging of foam from the fresh beer storage keg 21-1 concludes when a predetermined period of time has elapsed. Accordingly, following elapse of the predetermined time period, the liquid cutoff device 33-1 is put into the delivery-disabled state. Further, the pressure-switching device 73-1 is put into the pressure-supply disabled state. This ends the discharging of beer via the second connection tube 25-1 into the waste-liquid receptacle WP. The system state at that point corresponds to the situation where, in earlier described State 1, beer is delivered from the beer storage keg 21-2.

Thereafter, with regard to storage keg 21-2, determination of State 1 through State 3 is made to control the operation of the liquid cutoff devices 31-1, 33-1, 31-2 and 33-2.

Actuating the liquid cutoff devices 31-1, 31-2, 33-1 and 33-2, and the pressure-switching devices 73-1 and 73-2 in response to this manner of change of state makes it possible to be able always to deliver beer, from the one of the beer storage kegs to the other of the beer storage kegs, without interruption.

2. Operation of Control Computer

Using the flowchart presented in FIG. 15, an explanation of the operation of the earlier-described CPU 411 of the control computer 41 will be made. Here, with regard to the following operation of the CPU 411, an instance in which beer is delivered from the beer storage keg 21-1 in an initial state, and thereafter the operational state is changed from State 1→State 2→State 3 will be explained.

Since instances in which beer is delivered from beer storage keg 21-2 in an initial state are similar to instances in which beer is delivered from beer storage keg 21-1, description thereof is omitted. Also, processes that are likewise as with Embodiment Example 1 are labeled with the same numbers, and detailed description of the processes is omitted. In addition, because the status of the beer inside the beer storage-keg switching device 52 in each state is likewise as with Embodiment Example 1, in the explanation below, FIG. 9 through FIG. 11 of Embodiment Example 1 are referred to.

Figure 15:
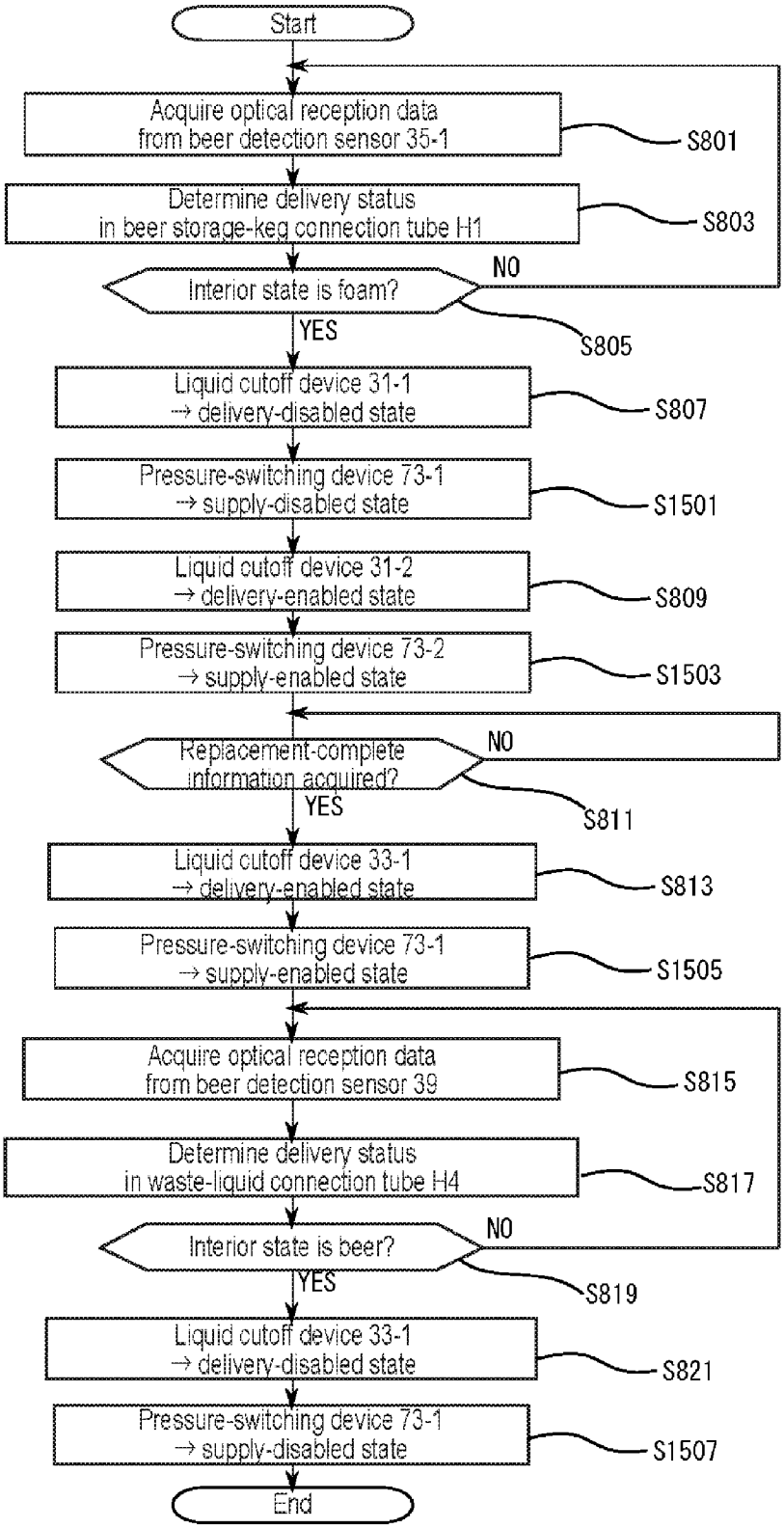
FIG. 15 is a flowchart indicating operations in the CPU 411.

In State 1 (cf. FIG. 9), as indicated in FIG. 15, the CPU 411 acquires optical reception data indicating the amount of infrared light received from the beer-detection sensor 35-1 (S801). The CPU 411 determines, based on the acquired optical reception data, the delivery status of beer in the beer storage-keg connection tube H1, which is provided with the beer-detection sensor 35-1 (S803).

When the CPU 411 determines, based on the optical reception data from the beer-detection sensor 35-1, that the bubbles have gone out of the beer storage keg 21-1 (S805), it determines that delivery of beer from the beer storage keg 21-1 has concluded, and operates the liquid cutoff device 31-1 to put the device into the delivery-disabled state (S807). The CPU 411 also puts the pressure-switching device 73-1 into the pressure-supply disabled state (S1501). Next, the CPU 411 operates the liquid cutoff device 31-2 to put it into the delivery-enabled state (S809). In addition, the CPU 411 puts the pressure-switching device 73-2 into the pressure-supply enabled state (S1503). This enables, in the supplying of beer, changing from the beer storage keg 21-1 over to the beer storage keg 21-2 without the delivery of beer ceasing.

In State 2 (cf. FIG. 10), the user of the beer delivery system 1 detaches the beer storage keg 21-1 connected to the beer storage-keg connection tube H1 and connects a freshly readied beer storage keg 21-1 with the beer storage-keg connection tube H1 to complete an exchange of beer storage kegs 21-1. When the user completes the exchange of beer storage kegs 21-1, he or she presses the beer storage-keg replacement button B provided on the beer storage-keg switching device 12.

As indicated in FIG. 15, when the CPU 411 acquires replacement-complete information from the beer storage-keg replacement button B (S811), it operates the liquid cutoff device 33-1 to put it into the delivery-enabled state (S813). In addition, the CPU 411 puts the pressure-switching device 73-1 into the pressure-supply enabled state (S1505). Bubbles delivered from the beer storage keg 21-1 in the initial stage following the beer storage-keg exchange are thereby discharged to the waste-liquid receptacle WP in the dispenser 11.

After that, in State 3, as indicated in FIG. 11, the beer storage-keg connection tube H1, the second connection tube 25-1, and the waste-liquid connection tube H4 are filled with foam, owing to bubbles that come from the beer storage keg 21-1.

In State 3 (cf. FIG. 11), as indicated in FIG. 15, the CPU 411 acquires from the beer-detection sensor 39 optical reception data indicating the amount of infrared light received (S815). The CPU 411 determines, based on the acquired optical reception data, the delivery status of beer in the waste-liquid connection tube H4, which is provided with the beer-detection sensor 39 (S817). When the CPU 411 determines, based on the optical reception data from the beer-detection sensor 39, that in the location where this beer-detection sensor 39 is disposed, beer rather than foam is flowing (S819), it operates the liquid cutoff device 33-1 to put the device into the delivery-disabled state (S821). At the same time, the CPU 411 puts the pressure-switching device 73-1 into the pressure-supply disabled state (S1507).

Embodiment Example 3

With the aforedescribed beer delivery system 1 involving Embodiment Example 1, maintenance management and hygiene management can be conducted with ease. Meanwhile, a beer delivery system involving the present embodiment example makes it possible to keep beer from leaking to the exterior when the beer storage kegs are replaced. It should be noted that in the following, configurational structures that are the same as those of Embodiment Example 1 are labeled with the same reference marks. Furthermore, detailed description of configurational structures that are the same as those of Embodiment Example 1 are omitted.

Part 1: Configuration of Liquid Delivery System

Figure 2:
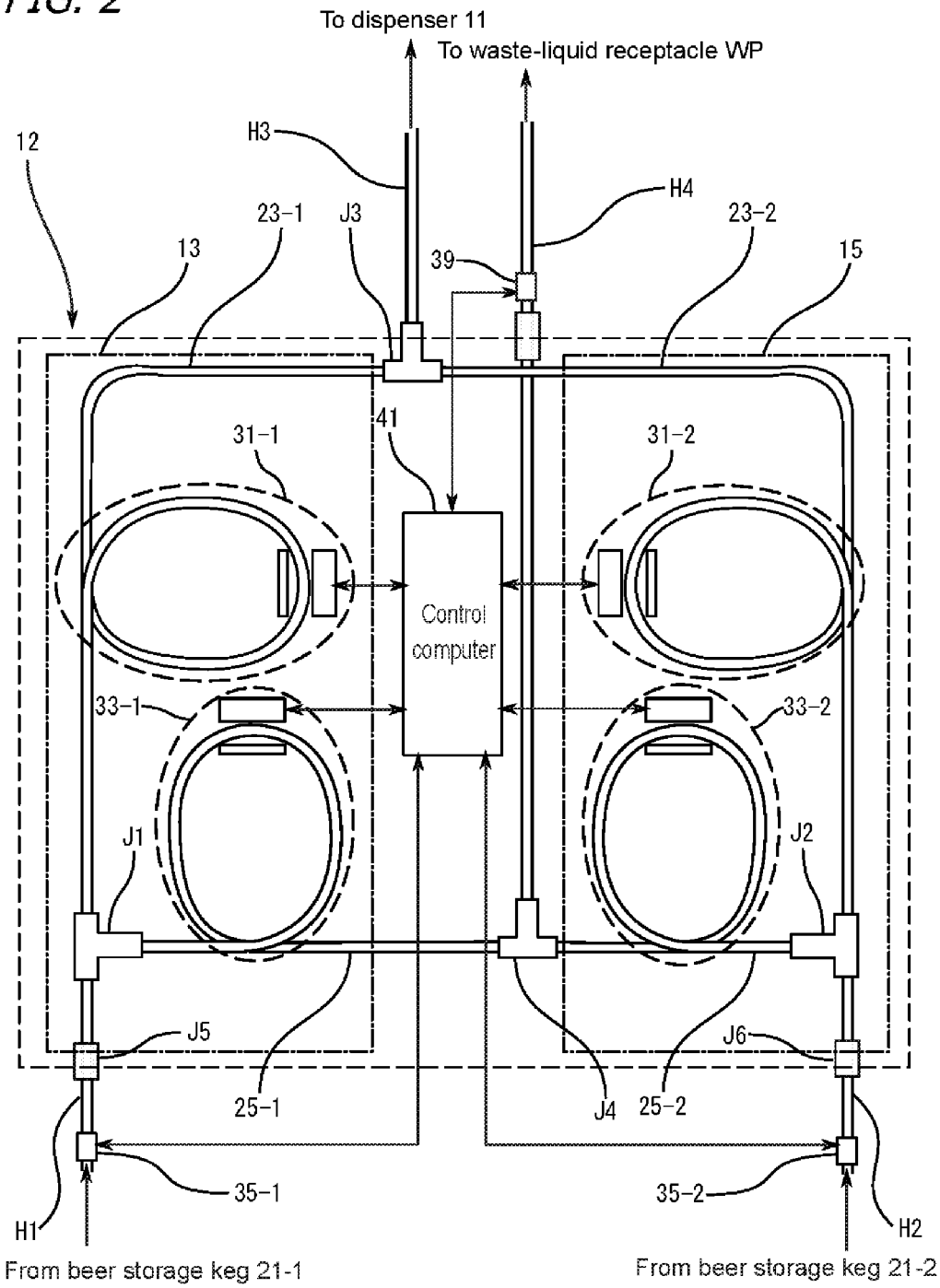
FIG. 2 is a configuration diagram of the beer storage-keg switching device 12 in FIG. 1.

The configuration of a beer delivery system that is one mode of embodying a liquid delivery system involving the present invention is the same as the configuration of the beer delivery system 1 in Embodiment Example 1 (cf. FIG. 1 and FIG. 2).

Part 2: Control Computer

1. Control Outline

The control computer 41 in the present embodiment example controls the operation of the liquid cutoff devices 31-1, 33-1, 31-2 and 33-2 in accordance with the beer delivery state that it determines based on data obtained from the beer-detection sensors 35-1, 35-2 and 39. This makes it possible to prevent rupturing of the first connection tubes 23-1 and 23-2 from occurring in proximity to the liquid cutoff devices 31-1 and 31-2 when the beer storage kegs 21-1 and 21-2 are being replaced with fresh kegs.

Using FIG. 16, an outline of operational control in the control computer 41 with respect to the liquid cutoff devices 31-1, 33-1, 31-2 and 33-2 will be made.

Supposed herein is an instance of switching from a state in which beer is delivered to the dispenser 11 from the first beer-delivery network section 13 (State 1), to a state in which it is delivered to the dispenser 11 from the second beer-delivery network section 15 (State 2), and of thereafter rendering a state in which a countermeasure for preventing rupture of the first connection tube 23-1 is implemented on the first beer-delivery network section 13 having finished supplying beer (State 11).

In State 1, in which beer is delivered through the first beer-delivery network section 13, it is necessary that the beer stored in the beer storage keg 21-1 be delivered to the dispenser 11 via the first connection tube 23-1. Accordingly, liquid cutoff device 31-1 alone is put into the delivery-enabled state, while the other liquid cutoff devices are put into the delivery-disabled state.

After that, when the beer stored in the beer storage keg 21-1 runs out and State 2, in which beer is supplied from the other beer storage keg 21-2, is switched into, it is necessary to halt the delivery of beer to the dispenser 11 from the beer storage keg 21-1, made via the first connection tube 23-1, and begin delivery of beer to the dispenser 11 from the beer storage keg 21-2, made via the first connection tube 23-2. Accordingly, liquid cutoff device 31-1 is put into the delivery-disabled state and liquid cutoff device 31-2 is put into the delivery-enabled state, with the other liquid cutoff devices being put into the delivery-disabled state.

Next, the system is put into State 11, in which, prior the beer storage keg 21-1 being exchanged with a fresh keg, a rupture-prevention countermeasure of creating an empty discharge flowpath, leading from the beer storage keg 21-1 to the waste-liquid receptacle WP in the dispenser 11, is implemented. In this case, after the liquid cutoff device 31-1 has been put into the delivery-disabled state, the liquid cutoff device 33-1 is then put into the delivery-enabled state (State 11*a*). Doing so forms a discharge flowpath from the beer storage keg 21-1 to the waste-liquid receptacle WP. In the initial stage in which the liquid cutoff device 33-1 has been put into the delivery-enabled state, when the beer storage keg 21-1 goes empty, bubbles spouting from the beer storage keg 21-1 are discharged into the discharge flowpath. With the elapse of a predetermined time period, the discharging of bubbles concludes. At that stage, although nothing is discharged from the beer storage keg 21-1 any longer, by continuing the discharge further, bubbles present in the discharge flowpath can be discharged to the waste-liquid receptacle WP. An empty discharge flowpath is thereby created. After the elapse of a predetermined time period the liquid cutoff device 33-1 is put into the delivery-disabled state (State 11*b*), readying it for the replacement of the beer storage keg 21-1.

In this way preparatorily creating an empty discharge flowpath makes it so that when the beer storage keg 21-1 is replaced with a fresh keg, the high pressure that until then had been acting on the first connection tube 23-1 and the liquid cutoff device 31-1 can be vented to the exterior through the discharge flowpath. Consequently, rupturing of the first connection tube 23-1 in the vicinity of the liquid cutoff device 31-1 can be prevented.

It will be appreciated that after this manner of rupture-prevention countermeasure has been implemented, the beer storage keg 21-1 is replaced with a fresh keg.

2. Operation of Control Computer

Using the flowchart presented in FIG. 17, an explanation of the operation of the earlier-described CPU 411 of the control computer 41 will be made. Here, with regard to the following operation of the CPU 411, an instance in which beer is delivered from the beer storage keg 21-1 in an initial state, and thereafter the operational state is changed from State 1→State 2→State 11 will be explained. Inasmuch as the situation where beer is delivered from beer storage keg 21-2 in the initial state is similar to the situation where beer is delivered from beer storage keg 21-1, description thereof is omitted.

As indicated in FIG. 9, in State 1, in the situation where beer is delivered from the beer storage keg 21-1, the beer storage-keg connection tube H1, the first connection tube 23-1 from joint J5 to joint J3, and the dispenser connection tube H3 are filled with beer that the beer storage keg 21-1 has supplied. Further, the second connection tube 25-1, in the range from joint J1 to the liquid cutoff device 33-1, is also filled with beer that the beer storage keg 21-1 supplies. In addition, the first connection tube 23-2, in the range from joint J3 to the liquid cutoff device 31-2, is filled with beer that the beer storage keg 21-1 has supplied.

Let it be assumed, meanwhile, that preparation for beer delivery of the beer storage keg 21-2, furnished in situations where the delivery of beer from the beer storage keg 21-1 has concluded, has already been completed. In that case, the beer storage-keg connection tube H2, the first connection tube 23-2 from joint J6 to liquid cutoff device 31-2, and the second connection tube 25-2 from joint J2 to liquid cutoff device 33-2 are filled with beer that the beer storage keg 21-2 has supplied.

Figure 17:
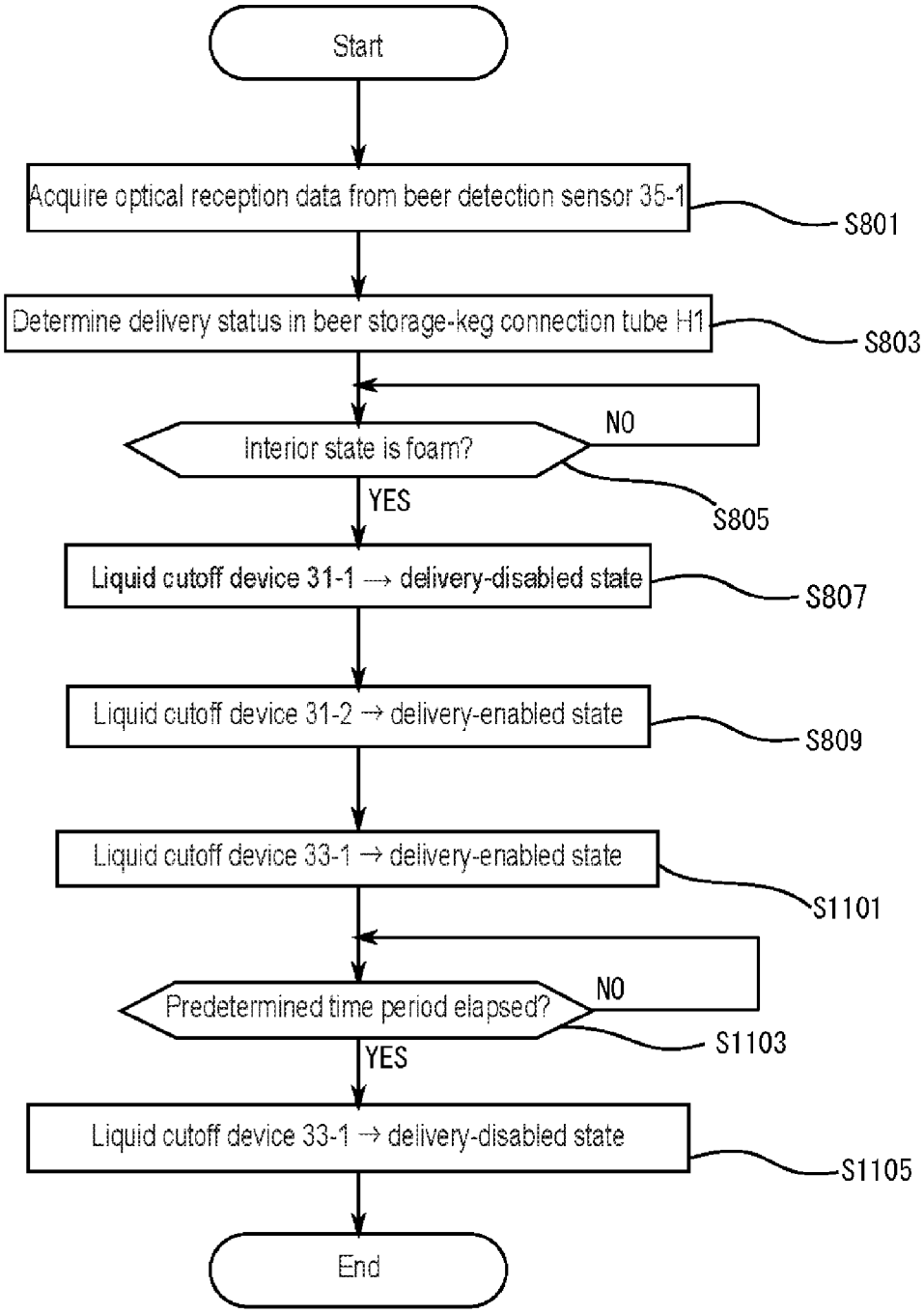
FIG. 17 is a flowchart indicating operations in the CPU 411 in Embodiment Example 3.

In the situation thus, as indicated in FIG. 17, the CPU 411 acquires optical reception data indicating the amount of infrared light received from the beer-detection sensor 35-1 (S801). The CPU 411 determines, based on the acquired optical reception data, the delivery status of beer in the beer storage-keg connection tube H1, which is provided with the beer-detection sensor 35-1 (S803). The beer-detection sensor 35-1 is provided in the vicinity of where the beer storage keg 21-1 and the beer storage-keg connection tube H1 connect. The beer-detection sensor 35-1 is therefore able most rapidly to detect the delivery status of beer from the beer storage keg 21-1.

When the CPU 411 determines, based on the optical reception data from the beer-detection sensor 35-1, that the bubbles have gone out of the beer storage keg 21-1 (S805), it determines that delivery of beer from the beer storage keg 21-1 has concluded, and operates the liquid cutoff device 31-1 to put the device into the delivery-disabled state (S807). In addition, the CPU 411 operates the liquid cutoff device 31-2 to put it into the delivery-enabled state (S809). This enables, in the supplying of beer, changing from the beer storage keg 21-1 over to the beer storage keg 21-2 without the delivery of beer ceasing.

As indicated in FIG. 10, in State 2, beer is delivered from the beer storage keg 21-2, whereby the beer storage-keg connection tube H2, the first connection tube 23-2 from joint J6 to joint J3, and the dispenser connection tube H3 are filled with beer that the beer storage keg 21-2 has supplied.

Next, in order to shift the system from State 2 to State 11*a*, the CPU 411 puts the liquid cutoff device 33-1 into the delivery-enabled state (S1101). That way, by putting the liquid cutoff device 33-1 into the delivery-enabled state, beer present inside the waste-liquid flowpath, indicated in FIG. 10, that ranges through the beer storage-keg connection tube H1, the joint J1, the second connection tube 25-1, the joint J4, and the waste-liquid connection tube H4, as well as bubbles freshly discharged from the beer storage keg 21-1, can be discharged to the waste-liquid receptacle WP, rendering an empty waste-liquid flowpath. State 11, in which the empty waste-liquid flowpath has been created, is represented in FIG. 11.

The beer storage keg 21-1 discharges foam for a predetermined time period. Accordingly, as indicated in FIG. 17, when the CPU 411 determines that the predetermined time period has elapsed (S1103), it puts the liquid cutoff device 33-1 into the delivery-disabled state (S1105) in order to shift the system from State 11*a* to State 11*b*. Here, the predetermined time period during which the beer storage keg 21-1 discharges foam is calculated in advance and stored in the memory.

Herein, the user of the beer delivery system 1 detaches the beer storage keg 21-1 connected to the beer storage-keg connection tube H1 and connects a freshly readied beer storage keg 21-1 with the beer storage-keg connection tube H1 to complete an exchange of beer storage kegs 21-1.

By creating an empty waste-liquid flowpath in this way, when replacement of the beer storage keg 21-1 has been completed, the high pressure that had been acting on the interior of the beer storage keg 21-1 can be vented to the exterior through the empty discharge flowpath. That is, the high pressure that had been acting on the interior of the beer storage keg 21-1 can be stopped from acting on the first connection tube 23-1 and the liquid cutoff device 31-1, whereby rupturing of the first connection tube 23-1 in the vicinity of the liquid cutoff device 31-1 can be prevented.

Embodiment Example 4

With the aforedescribed beer-delivery system involving Embodiment Example 3, the system was rendered, in the same way as in Embodiment Example 1, with the beer storage kegs 21-1 and 21-2 employing the carbon-dioxide tanks 22-1 and 22-2, connected respectively to each, to deliver the beer stored therein. With a beer-delivery system involving the present embodiment example, meanwhile, in the same manner as with Embodiment Example 2 the stored beer is delivered by controlling the pressure supplied from the carbon dioxide tanks connected to the two beer storage kegs 21-1 and 21-2. It should be noted that in the following, configurational structures that are the same as those of Embodiment Examples 1 through 3 are labeled with the same reference marks. Furthermore, detailed description of configurational structures that are the same as those of Embodiment Examples 1 through 3 are omitted.

Part 1: Configuration of Liquid Delivery System

Figure 12:
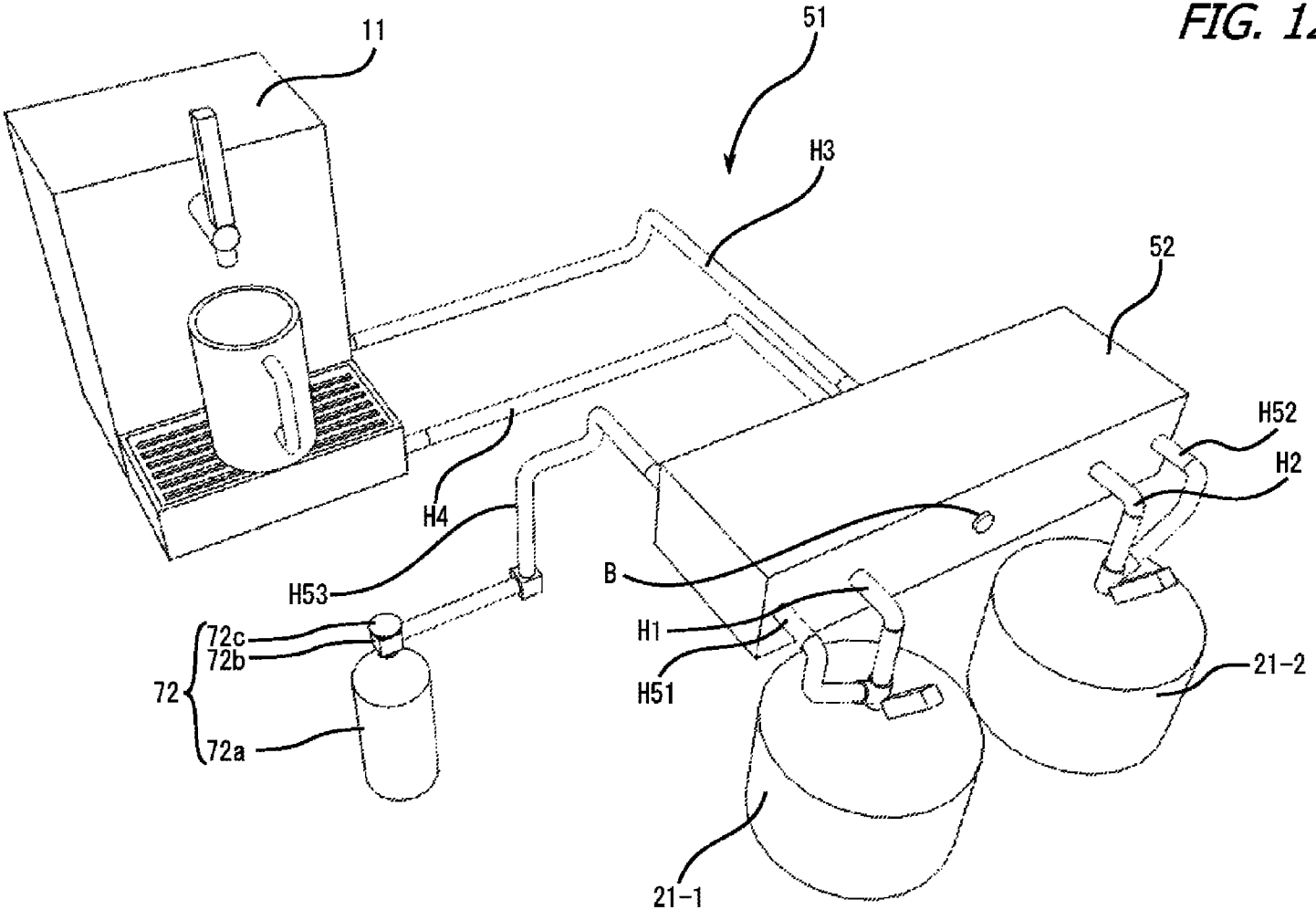
FIG. 12 is a configuration diagram of a beer delivery system 51 in Embodiment Example 2 of a liquid delivery system involving the present invention.

The configuration of a beer delivery system that is one mode of embodying a liquid delivery system involving the present invention is the same as the configuration of the beer delivery system 1 in Embodiment Example 2 (cf. FIG. 12 and FIG. 13).

Part 2: Control Computer

1. Control Outline

Using FIG. 18, an explanation of the control computer 41 involving the present embodiment example will be made. The control computer 41 controls the operation of the liquid cutoff devices 31-1, 33-1, 31-2 and 33-2, and the pressure-switching devices 73-1 and 73-2 in accordance with the beer delivery state that it determines based on data obtained from the beer-detection sensors 35-1, 35-2 and 39. This makes it possible to prevent rupturing of the first connection tubes 23-1 and 23-2 from occurring in proximity to the liquid cutoff devices 31-1 and 31-2 when the beer storage kegs 21-1 and 21-2 are being replaced with fresh kegs.

Supposed herein, likewise as with Embodiment Example 1, is an instance of switching from a state in which the beer is delivered to the dispenser 11 from the first beer-delivery network section 13 (State 1), to a state in which it is delivered to the dispenser 11 from the second beer-delivery network section 15 (State 2), and of thereafter rendering a state in which a countermeasure for preventing rupture of the first connection tube 23-1 is implemented on the first beer-delivery network section 13 having finished supplying beer (State 11).

In State 1, in which beer is delivered through the first beer-delivery network section 13, it is necessary that the beer stored in the beer storage keg 21-1 be delivered to the dispenser 11 via the first connection tube 23-1. Accordingly, as far as the liquid cutoff devices are concerned, liquid cutoff device 31-1 alone is put into the delivery-enabled state, while the other liquid cutoff devices are put into the delivery-disabled state. As far as the pressure-switching devices are concerned, pressure-switching device 73-1 is put into the pressure-supply enabled state so as to let beer be delivered from the beer storage keg 21-1. On the other hand, pressure-switching device 73-2 is put into the pressure-supply disabled state.

After that, when the beer stored in the beer storage keg 21-1 runs out and State 2, in which beer is supplied from the other beer storage keg 21-2, is switched into, it is necessary to halt the delivery of beer to the dispenser 11 from the beer storage keg 21-1, made via the first connection tube 23-1, and begin delivery of beer to the dispenser 11 from the beer storage keg 21-2, made via the first connection tube 23-2. Accordingly, as far as the liquid cutoff devices are concerned, liquid cutoff device 31-1 is put into the delivery-disabled state and liquid cutoff device 31-2 is put into the delivery-enabled state, with the other liquid cutoff devices being put into the delivery-disabled state. As far as the pressure-switching devices are concerned, pressure-switching device 73-2 is put into the pressure-supply enabled state so as to let beer be delivered from the beer storage keg 21-2. On the other hand, pressure-switching device 73-1 is put into the pressure-supply disabled state. Here, switching the states of pressure-switching device 73-1 and pressure-switching device 73-2 is done roughly simultaneously. Alternatively, after the state of pressure-switching device 73-1 has been switched over, the state of pressure-switching device 73-2 is switched over.

Next, the system is put into State 11, in which, prior the beer storage keg 21-1 being exchanged with a fresh keg, a rupture-prevention countermeasure of creating an empty discharge flowpath, leading from the beer storage keg 21-1 to the waste-liquid receptacle WP in the dispenser 11, is implemented. In this case, after the liquid cutoff device 31-1 has been put into the delivery-disabled state, the liquid cutoff device 33-1 is then put into the delivery-enabled state (State 11*a*). Doing so forms a discharge flowpath from the beer storage keg 21-1 to the waste-liquid receptacle WP.

In addition, the pressure-switching device 73-1 is put into the pressure-supply enabled state (State 11*b*). Doing so discharges bubbles spouting from the beer storage keg 21-1 into the discharge flowpath when the beer storage keg 21-1 goes empty in the initial stage in which the liquid cutoff device 33-1 has been put into the delivery-enabled state. With the elapse of a predetermined time period, the discharging of bubbles concludes. At that stage, although nothing is discharged from the beer storage keg 21-1 any longer, by continuing the discharge further, bubbles present in the discharge flowpath can be discharged to the waste-liquid receptacle WP. An empty discharge flowpath is thereby created. Lastly, the pressure-switching device 73-1 is put into the pressure-supply disabled state (State 11*c*), after which the liquid cutoff device 33-1 is put into the delivery-disabled state (State 11*d*).

In this way preparatorily creating an empty discharge flowpath makes it so that when the beer storage keg 21-1 is replaced with a fresh keg, the high pressure that until then had been acting on the first connection tube 23-1 and the liquid cutoff device 31-1 can be vented to the exterior through the discharge flowpath. Consequently, rupturing of the first connection tube 23-1 in the vicinity of the liquid cutoff device 31-1 can be prevented.

It will be appreciated that after this manner of rupture-prevention countermeasure has been implemented, the beer storage keg 21-1 is replaced with a fresh keg.

2. Operation of Control Computer

Using the flowchart presented in FIG. 19, an explanation of the operation of the earlier-described CPU 411 of the control computer 41 will be made. Here, with regard to the following operation of the CPU 411, an instance in which beer is delivered from the beer storage keg 21-1 in an initial state, and thereafter the operational state is changed from State 1→State 2→State 11 will be explained.

Since instances in which beer is delivered from beer storage keg 21-2 in an initial state are similar to instances in which beer is delivered from beer storage keg 21-1, description thereof is omitted. Also, processes that are likewise as with Embodiment Example 1 are labeled with the same numbers, and detailed description of the processes is omitted. In addition, because the status of the beer inside the beer storage-keg switching device 52 in each state is likewise as with Embodiment Example 1, in the explanation below, FIG. 9 through FIG. 11 of Embodiment Example 1 are referred to.

Figure 19:
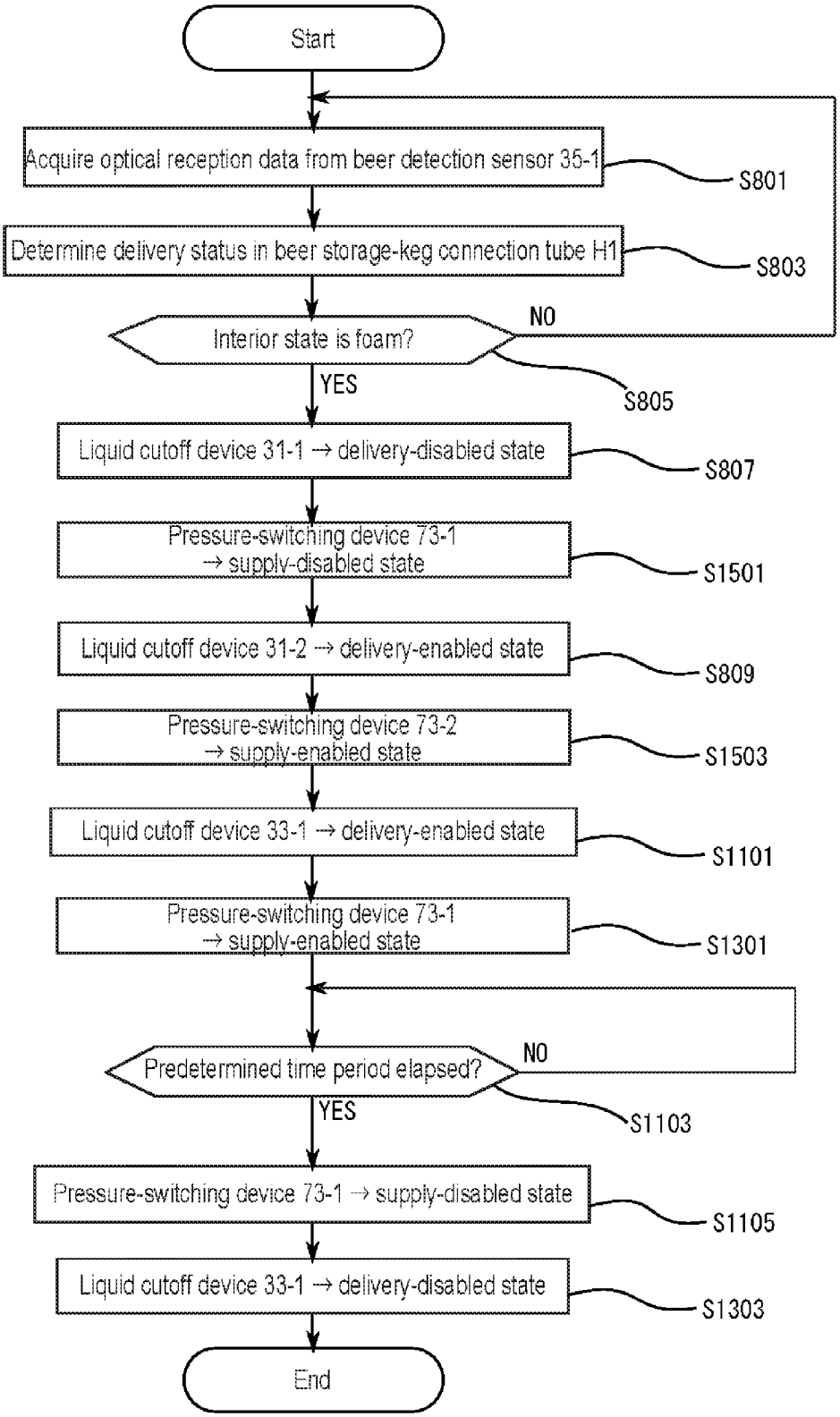
FIG. 19 is a flowchart indicating operations in the CPU 411 in Embodiment Example 4.

In State 1 (cf. FIG. 9), as indicated in FIG. 19, the CPU 411 acquires optical reception data indicating the amount of infrared light received from the beer-detection sensor 35-1 (S801). The CPU 411 determines, based on the acquired optical reception data, the delivery status of beer in the beer storage-keg connection tube H1, which is provided with the beer-detection sensor 35-1 (S803).

When the CPU 411 determines, based on the optical reception data from the beer-detection sensor 35-1, that the bubbles have gone out of the beer storage keg 21-1 (S805), it determines that delivery of beer from the beer storage keg 21-1 has concluded, and operates the liquid cutoff device 31-1 to put the device into the delivery-disabled state (S807). The CPU 411 also puts the pressure-switching device 73-1 into the pressure-supply disabled state (S1501). Next, the CPU 411 operates the liquid cutoff device 31-2 to put it into the delivery-enabled state (S809). In addition, the CPU 411 puts the pressure-switching device 73-2 into the pressure-supply enabled state (S1503). This enables, in the supplying of beer, changing from the beer storage keg 21-1 over to the beer storage keg 21-2 without the delivery of beer ceasing.

In State 2 (cf. FIG. 10), beer is delivered from the beer storage keg 21-2, whereby the beer storage-keg connection tube H2, the first connection tube 23-2 from joint J6 to joint J3, and the dispenser connection tube H3 are filled with beer that the beer storage keg 21-2 has supplied.

Next, in order to shift the system from State 2 to State 11*a*, the CPU 411 puts the liquid cutoff device 33-1 into the delivery-enabled state (S1101). In this way putting the liquid cutoff device 33-1 into the delivery-enabled state makes it possible to create the waste-liquid flowpath, indicated in FIG. 10, that ranges through the beer storage-keg connection tube H1, the joint J1, the second connection tube 25-1, the joint J4, and the waste-liquid connection tube H4.

Furthermore, the CPU 411 puts the pressure-switching device 73-1 into the pressure-supply enabled state in order to shift the system from State 11*a* to State 11*b* (S1301). Beer present inside the waste-liquid flowpath, and bubbles freshly discharged from the beer storage keg 21-1 may thereby be discharged to the waste-liquid receptacle WP. That is, the waste-liquid flowpath is brought into the rendered-empty State 11 (cf. FIG. 11).

The beer storage keg 21-1 discharges foam for a predetermined time period. Accordingly, as indicated in FIG. 19, when the CPU 411 determines that the predetermined time period has elapsed (S1103), it puts the pressure-switching device 73-1 into the pressure-supply disabled state (S1105) in order to shift the system from State 11*b* to State 11*c*. In addition, the CPU 411 puts the liquid cutoff device 33-1 into the delivery-disabled state (S1303) in order to shift the system from State 11*c* to State 11*d*. Here, the predetermined time period during which the beer storage keg 21-1 discharges foam is calculated in advance and stored in the memory.

Herein, the user of the beer delivery system 1 detaches the beer storage keg 21-1 connected to the beer storage-keg connection tube H1 and connects a freshly readied beer storage keg 21-1 with the beer storage-keg connection tube H1 to complete an exchange of beer storage kegs 21-1.

By creating an empty waste-liquid flowpath in this way, when replacement of the beer storage keg 21-1 has been completed, the high pressure that had been acting on the interior of the beer storage keg 21-1 can be vented to the exterior through the empty discharge flowpath. That is, the high pressure that had been acting on the interior of the beer storage keg 21-1 can be stopped from acting on the first connection tube 23-1 and the liquid cutoff device 31-1, whereby rupturing of the first connection tube 23-1 in the vicinity of the liquid cutoff device 31-1 can be prevented.

Embodiment Example 5

With the beer delivery system in aforedescribed Embodiment Example 1, the liquid cutoff device that is disposed on the first connection tube which is joined to the beer storage keg that is replaced during replacing of a beer storage keg is put into the delivery-disabled state, while the liquid cutoff device that is disposed on the discharge conduit is put into the delivery-enabled state to form the discharge flowpath. Therefore, with the beer delivery system 1 there can be instances where the liquid cutoff device that is disposed on the first connection tube is in the delivery-disabled state for a lengthy period, such as when a fresh beer storage keg cannot be readied right away, or when it has not been noticed that a beer storage keg has gone empty and is in a state where replacement is necessary. If the liquid cutoff device is in the delivery-disabled state for a lengthy period, there is a likelihood that kink traces and kinking propensities will remain in the first connection tube, such that (later-described) sponge-washing of the first connection tube cannot be carried out properly. Therein, with a beer delivery system in the present embodiment example, the liquid cutoff device disposed on the first connection tube joined to the beer storage keg replaced during replacing of a beer storage keg is prevented from being in the delivery-disabled state for an extended period.

Part 1: Sponge Washing

Sponge washing in the beer delivery system means, for example directly washing, by flushing a designated sponge along, the inner side of each of the tubes of the delivery flowpaths, formed beer storage keg 21-1 to dispenser 11, constituted through the beer storage-keg connection tube H1 to the first connection tube 23-1 to the dispenser connection tube H3.

As a method of sponge washing, for example, a washing barrel is hooked up in place of a beer storage keg. A designated sponge is sent from the washing barrel along the tubes forming the delivery flowpath, by applying to them a predetermined pressure via the washing barrel. The sponge sent along the interior of the tubes washes the inner side of each of the tubes as it travels. It will be appreciated that the sponge sent along the tube interiors ultimately is discharged through the discharge mouth of the dispenser 11.

By sending the sponge along the interior of the tubes in this way, the inner side of each tube can be washed directly.

Part 2: Configuration of Liquid Delivery System

The configuration of a beer delivery system that is one mode of embodying a liquid delivery system involving the present invention is the same as the configuration of the beer delivery system 1 in Embodiment Example 1 (cf. FIG. 1 and FIG. 2).

Part 3: Control Computer

1. Control Outline

The control computer 41 controls the operation of the liquid cutoff devices 31-1, 33-1, 31-2 and 33-2 in accordance with the beer delivery state that it determines based on data obtained from the beer-detection sensors 35-1, 35-2 and 39. The liquid cutoff device that is disposed on the first connection tube which is joined to the beer storage keg that is replaced during replacing of a beer storage keg is thereby kept from being in the delivery-disabled state for a lengthy period, enabling washing of the first connection tube to be carried out properly.

Using FIG. 20, an outline of operational control in the control computer 41 with respect to the liquid cutoff devices 31-1, 33-1, 31-2 and 33-2 will be made.

Supposed herein is an instance of switching from a state in which beer is delivered to the dispenser 11 from the first beer-delivery network section 13 (State 1), to a state in which it is delivered to the dispenser 11 from the second beer-delivery network section 15 (State 2), of then rendering a state in which a countermeasure for preventing a long-term delivery-disabled state in the liquid cutoff device 31-1 disposed on the first connection tube 23-1 joined to beer storage keg 21-1, the supply of beer from which has finished, is implemented (State 5), and of thereafter rendering a state of preparing so that beer may be delivered anew from the first beer-delivery network section 13 (State 3).

The operation herein of each liquid cutoff device from State 1 to State 2 is the same as with Embodiment Example 1. After having been put into State 2, the liquid cutoff device 33-1 is put into the delivery-enabled state (State 5*a*) to form the discharge flowpath from the beer storage keg 21-1 to the waste-liquid receptacle WP. Following elapse of a predetermined time period, the liquid cutoff device 33-1 is put into the delivery-disabled state (State 5*b*). By forming the discharge flowpath in this way, gas residual in the beer storage keg 21-1 being replaced is given off, leaving the internal pressure of the beer storage keg 21-1 lowered and thereby preventing beer from being delivered via the first connection tube 23-1 when the liquid cutoff device 31-1 has been put into the delivery-enabled state.

Thereafter, the liquid cutoff device 31-1 is put into the delivery-enabled state (State 5*c*). In this way, during replacing of a beer storage keg, the period of time that the liquid cutoff device, disposed on the first connection tube joined to the beer storage keg that is replaced, will be in the delivery-disabled state is restricted, preventing it from being in the delivery-disabled state for a lengthy period, whereby kink traces and kinking propensities are stopped from remaining in the first connection tube, enabling sponge washing of the first connection tube to be carried out properly.

It will be appreciated that following the system's having been put into State 5*c*, the beer storage keg 21-1 is replaced with a fresh keg and the system is put into State 3.

2. Operation of Control Computer

Using the flowchart presented in FIG. 21, an explanation of the operation of the earlier-described CPU 411 of the control computer 41 will be made. It should be noted that below, with regard to the operation of the CPU 411 involving the present embodiment example, the operation from State 1 to State 2 is the same as with Step S801 through Step S809 in Embodiment Example 1. Accordingly, detailed description thereof is omitted.

After the system has been put into State 2, in order to shift the system from State 2 to State 5*a*, the CPU 411 puts the liquid cutoff device 33-1 into the delivery-enabled state (S2101). In this way putting the liquid cutoff device 33-1 into the delivery-enabled state creates the waste-liquid flowpath, indicated in FIG. 10, that ranges through the beer storage-keg connection tube H1, the joint J1, the second connection tube 25-1, the joint J4, and the waste-liquid connection tube H4. The interior of the beer storage keg 21-1 is thereby connected with the exterior, discharging gases residual in the beer storage keg 21-1 interior and making it possible to reduce the internal pressure of the beer storage keg 21-1.

Returning to FIG. 21: When the CPU 411 determines that a predetermined time period has elapsed (S2103), it puts the liquid cutoff device 33-1 into the delivery-disabled state in order to shift the system from State 5*a* to State 5*b* (S2105). Here, the predetermined time period during which the beer storage keg 21-1 discharges foam is calculated in advance and stored in the memory.

In order to shift the system from State 5*b* to State 5*c* the CPU 411 puts the liquid cutoff device 31-1 into the delivery-enabled state (S2107).

Then the user of the beer delivery system 1 detaches the beer storage keg 21-1 connected to the beer storage-keg connection tube H1 and connects a freshly readied beer storage keg 21-1 with the beer storage-keg connection tube H1 to complete an exchange of beer storage kegs 21-1.

In this way, during replacing of a beer storage keg, the period of time that the liquid cutoff device, disposed on the first connection tube joined to the beer storage keg that is replaced, will be in the delivery-disabled state is restricted, preventing it from being in the delivery-disabled state for a lengthy period, whereby kink traces and kinking propensities are stopped from remaining in the first connection tube, enabling sponge washing of the first connection tube to be carried out properly.

Embodiment Example 6

With the beer delivery system in aforedescribed Embodiment Example 5, the implementation had it that in beer delivery system 1 employing, likewise as with Embodiment Example 1, the carbon-dioxide tanks 22-1 and 22-2 connected respectively to the beer storage kegs 21-1 and 21-2 to deliver the beer stored in the beer storage kegs 21-1 and 21-2, the liquid cutoff device that is disposed on the first connection tube is prevented from being in the delivery-disabled state for a lengthy period. With a beer-delivery system involving the present embodiment example, meanwhile in the beer delivery system 51 delivering, in the same manner as with Embodiment Example 2, stored beer by controlling the pressure supplied from the carbon dioxide tanks connected to the two beer storage kegs 21-1 and 21-2, the liquid cutoff device disposed on the first connection tube is prevented from being in the delivery-disabled state for a prolonged period.

Part 1: Configuration of Liquid Delivery System

The configuration of a beer delivery system that is one mode of embodying a liquid delivery system involving the present invention is the same as the configuration of the beer delivery system 1 in Embodiment Example 1 (cf. FIG. 12 and FIG. 13).

Part 2: Control Computer

1. Control Outline

The control computer 41 controls the operation of the liquid cutoff devices 31-1, 33-1, 31-2 and 33-2 in accordance with the beer delivery state that it determines based on data obtained from the beer-detection sensors 35-1, 35-2 and 39. The liquid cutoff device that is disposed on the first connection tube which is joined to the beer storage keg that is replaced during replacing of a beer storage keg is thereby kept from being in the delivery-disabled state for a lengthy period, enabling washing of the first connection tube to be carried out properly.

Using FIG. 22, an outline of operational control in the control computer 41 with respect to the liquid cutoff devices 31-1, 33-1, 31-2 and 33-2 will be made.

Supposed herein is an instance of switching from a state in which beer is delivered to the dispenser 11 from the first beer-delivery network section 13 (State 1), to a state in which it is delivered to the dispenser 11 from the second beer-delivery network section 15 (State 2), of then rendering a state in which a countermeasure for preventing a long-term delivery-disabled state in the liquid cutoff device 31-1 disposed on the first connection tube 23-1 joined to beer storage keg 21-1, the supply of beer from which has finished, is implemented (State 15), and of thereafter rendering a state of preparing so that beer may be delivered anew from the first beer-delivery network section 13 (State 3).

The operation herein of each liquid cutoff device from State 1 to State 2 is the same as with Embodiment Example 1. After having been put into State 2, the liquid cutoff device 33-1 is put into the delivery-enabled state (State 15*a*) to form the discharge flowpath from the beer storage keg 21-1 to the waste-liquid receptacle WP. Following elapse of a predetermined time period, the liquid cutoff device 33-1 is put into the delivery-disabled state (State 15*b*). During that interval, the pressure-switching device 73-1 is put into the supply-disabled state. By forming the discharge flowpath in this way, gas residual in the beer storage keg 21-1 being replaced is given off, leaving the internal pressure of the beer storage keg 21-1 lowered and thereby preventing beer from being delivered via the first connection tube 23-1 when the liquid cutoff device 31-1 has been put into the delivery-enabled state.

Thereafter, the liquid cutoff device 31-1 is put into the delivery-enabled state (State 15*c*). In this way, during replacing of a beer storage keg, the period of time that the liquid cutoff device, disposed on the first connection tube joined to the beer storage keg that is replaced, will be in the delivery-disabled state is restricted, preventing it from being in the delivery-disabled state for a lengthy period, whereby kink traces and kinking propensities are stopped from remaining in the first connection tube, enabling sponge washing of the first connection tube to be carried out properly.

It will be appreciated that following the system's having been put into State 15*c*, the beer storage keg 21-1 is replaced with a fresh keg and the system is put into State 3.

2. Operation of Control Computer

Figure 21:
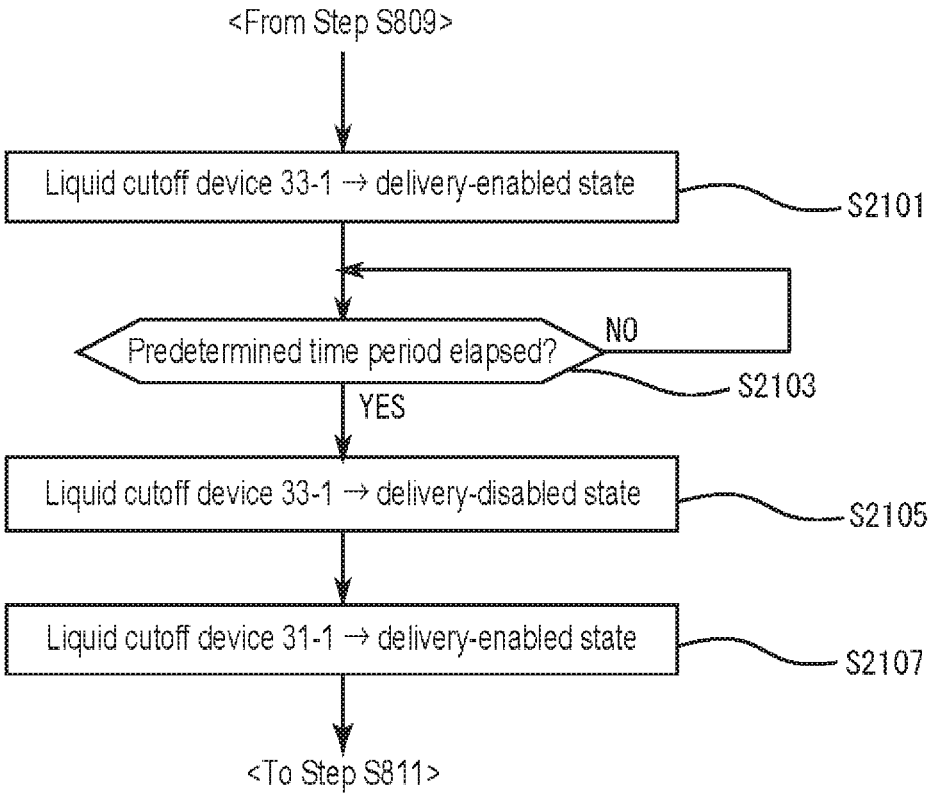
FIG. 21 is a flowchart indicating operations in the CPU 411 in Embodiment Example 5.

As far as the operation of the earlier-described CPU 411 of the control computer 41 is concerned, following Step S1503 in the flowchart of FIG. 15, indicating the operation of the CPU 411 in Embodiment Example 2, Steps S2101 through S2107 in the flowchart indicating the operation of the CPU 411 in Embodiment Example 5 are executed, and next after Step S2107 in FIG. 21, Step S811 in the flowchart of FIG. 15 in Embodiment Example 2 is executed. Accordingly, detailed description thereof is omitted.

Embodiment Example 7

With the beer delivery system in aforedescribed Embodiment Example 5, the system was rendered so that by limiting the time that the liquid cutoff device disposed on the first connection tube is in the delivery-disabled state, to keep it from being in the delivery-disabled state for a protracted period, kink traces and kinking propensities would not remain in the first connection tube, such that sponge-washing of the first connection tube could be properly performed. On the other hand, at times kink traces and kinking propensities unintentionally will form in the first connection tube, such that sponge washing cannot be carried out properly. With the beer delivery system in the present embodiment example, eliminating trouble owing to sponge-clogging that occurs when sponge washing is actually performed is made possible.

It will be appreciated that sponge-clogging during sponge cleaning sometimes occurs in instances where the pressure when the sponge is being fed through is low.

Part 1: Configuration

As to the configuration of a beer delivery system involving the present embodiment example, it is the same as that of Embodiment Example 1. In the beer storage-keg switching device 2, however, a rock button B71, employed in instances where feed-through of the sponge cannot be carried out properly, such as when the sponge clogs the tubes in sponge-washing, is disposed. Pressing the rock button B71 transmits a rock-start signal.

As to the internal configuration of the beer storage-keg switching device 2, it is the same as that of Embodiment Example 1. The liquid cutoff device 31-1, however, is designed to allow a sponge to travel suitably along the interior of the first connection tube 23-1.

Using FIG. 23, an explanation of the configuration of the liquid cutoff device 31-1 will be made. FIG. 23 is a simplified view of the internal structure of the liquid cutoff device 31-1 seen from the upper side. Inside the liquid cutoff device 31-1 movable part V4-1 situates the first connection tube 23-1 in a manner such that its looped conformation is sustained.

Figure 23A:
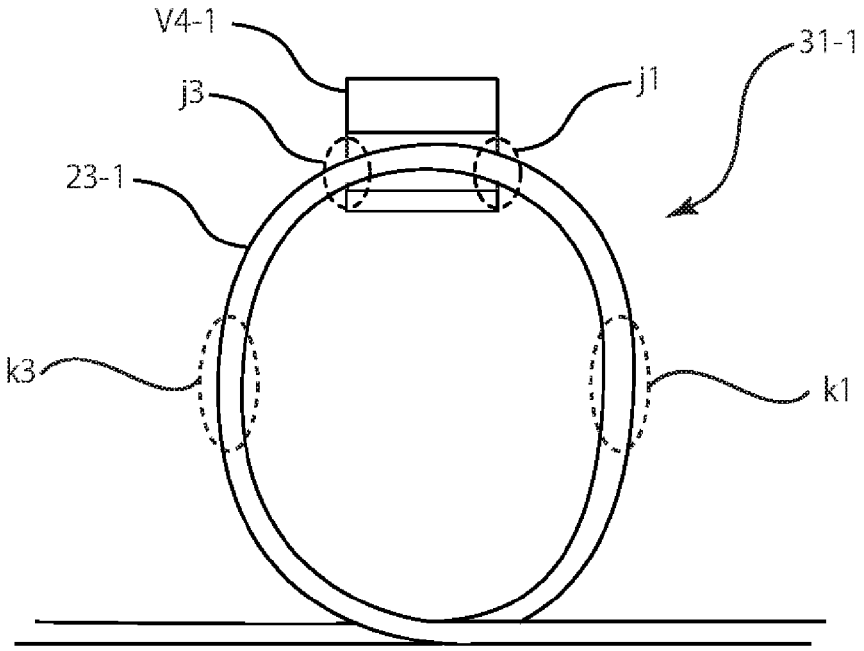
FIG. 23 is a simplified diagram illustrating the configuration of a liquid cutoff device 31-1 in Embodiment Example 7.

The movable part V4-1 has a base position, a first rocking position, and a second rocking position. As represented in FIG. 23A, the "first rocking position" means a location in which the movable part V4-1, with the size of the liquid cutoff device 31-1, the diameter of the tube, etc. taken into consideration, unforcedly sustains the first connection tube 23-1 in the looped conformation.

Figure 23B:
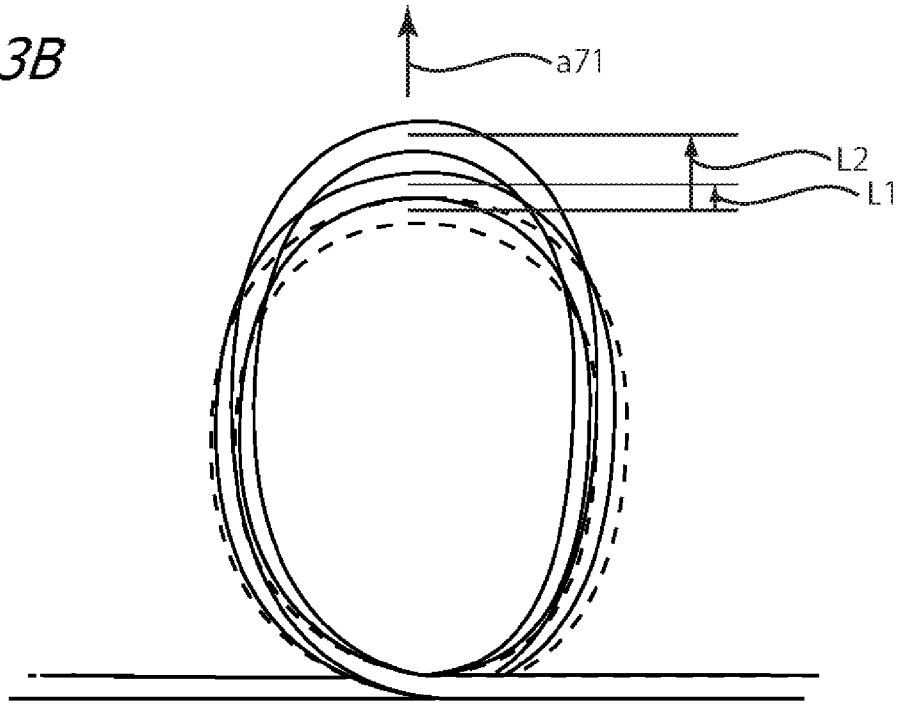

As represented in FIG. 23B, the "base position" means a location in which the movable part V4-1 sustains the first connection tube 23-1 in a looped conformation extended from the first rocking conformation in the direction of the arrow a71 by just a suitable length L1. The "second rocking position" means a location in which the movable part V4-1 sustains the looped conformation of the first connection tube 23-1 extended, from the looped conformation in the first rocking conformation, in the direction of the arrow a71 by just a suitable length L2 (L2>L1). It should be noted that in FIG. 23B, the looped formation of the first connection tube 23-1 in the first rocking position is indicated by dashed lines. Also, depiction of the movable part V4-1 is omitted in FIG. 23B.

In the liquid cutoff device 31-1, during ordinary use the movable part V4-1 is in the base position in the delivery-enabled state. In this way, by having the movable part V4-1 in the delivery-enabled state during ordinary use be in the base position, the first connection tube 23-1 in the delivery-enabled state is constantly in a state of being somewhat stretched. Therefore, kink traces and kinking propensities can be prevented from occurring in kink locations k1 and k3 (cf. FIG. 23A) in the first connection tube 23-1 when iterating between the delivery-enabled state and the delivery-disabled state in the liquid cutoff device 31-1

The situation is likewise with the liquid cutoff device 31-2.

Part 2: Control Computer

Figure 24:
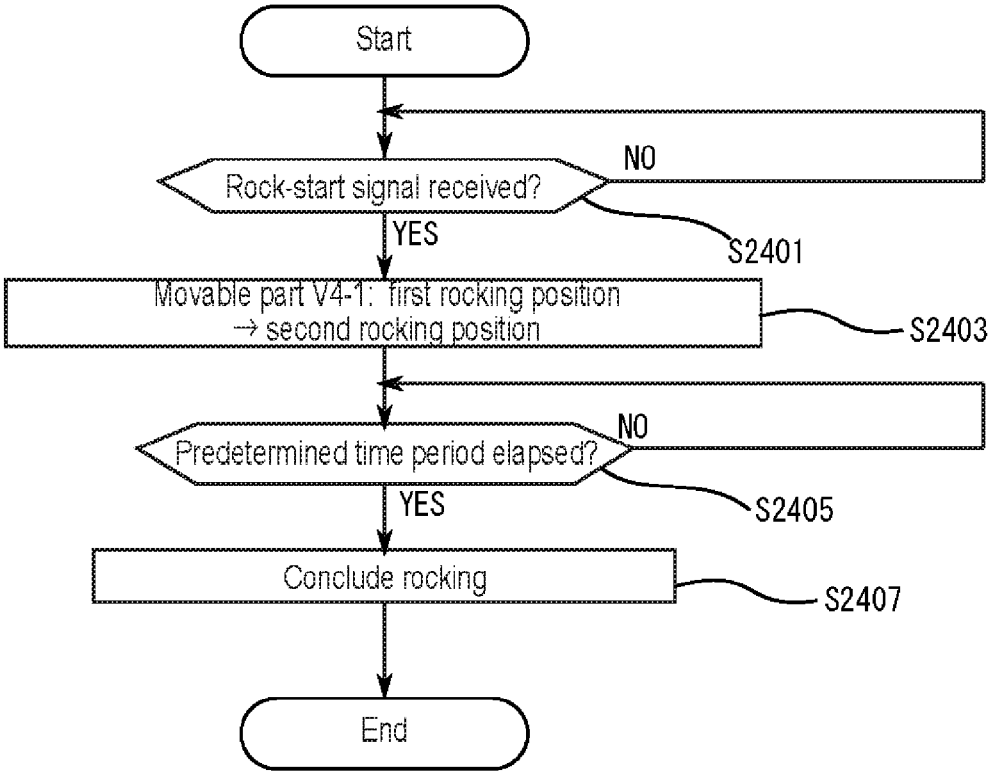
FIG. 24 is a flowchart setting forth a rocking operation by the liquid cutoff devices 31-1 and 31-2 that the control computer CPU 411 executes in Embodiment Example 7.

Using the flowchart presented in FIG. 24, a rocking operation in the liquid cutoff devices 31-1 and 31-2 that the CPU 411 of the control computer in the present embodiment example executes will be explained.

If a user of the beer delivery system during a sponge washing determines that the sponge has gotten stuck, the user actuates the rock button B71. Doing so starts the rocking action in the liquid cutoff devices 31-1 and 31-2.

The CPU 411 acquires a rock-start signal (S2401) via the rock button B71, and causes the movable part V4-1 in the liquid cutoff device 31-1 to move from the first rocking position to the second rocking position (S2403). In this way causing the movable part V4-1 to move from the first rocking position to the second rocking position enables it to tug suitably on the first connection tube 23-1 repeatedly, whereby the sponge in the interior of the looped conformation that the first connection tube 23-1 forms can flow easily. In particular, causing the movable part V4-1 to move from the base position to the second rocking position is effective in instances where the sponge has become stuck in the kink locations k1 and k3.

Likewise, causing the movable part V4-1 to move from the first rocking position to the base position is effective in instances where the sponge has become stuck in impressing locations j1 and j3. The "impressing locations j1 and j3" mean, as indicated in FIG. 23A, the locations where, by the movable part V4-1 movements that form the delivery-enabled state and the delivery-disabled state, the movable part V4-1 impresses the first connection tube 23-1 in the looped formation. The impressing locations j1 and j3 on the first connection tube 23-1 are repeatedly impressed upon due to the movement of the moveable part V4-1. For this reason, in the impressing locations j1 and j3, similarly as with kink traces and kinking propensities, impression traces and collapsing propensities sometimes occur. Impression traces and collapsing propensities having formed in the first connection tube 23-1 are causative factors impeding the travel of the sponge in sponge-washing.

Returning to FIG. 24: When the CPU 411 determines that a predetermined time period has elapsed (S2405), it concludes the movement of the movable part V4-1 (S2407).

Other Embodiment Examples (1) Liquid Cutoff Device

In aforedescribed Embodiment Example 1 through Embodiment Example 4, for the liquid cutoff devices 33-1 and 33-2, while implementations having loop sections and that form the kinks by impression have been illustrated, as long as the devices allow the flow of beer or other liquid to be controlled, they are not limited to those illustrated. For example, the devices may be electromagnetic valves or mechanical valves.

(2) Beer-Detection Sensor Placement Location

In aforedescribed Embodiment Example 1 through Embodiment Example 7, the implementations had the beer-detection sensor 35-1 provided in the vicinity of where the beer storage-keg connection tube H1 and the beer storage keg 21-1 connect, but as long as they allow the beer delivery state of the beer storage keg 21-1 to be detected, the implementations are not limited to those illustrated.

For example, beer-detection sensor 35-1 may be arranged in the vicinity of the joint J1 connecting the first connection tube 23-1 with the second connection tube 25-1, so as to dispose it in the interior of the beer storage-keg switching device 12. In that case, the region R1, indicated in FIG. 10, from joint J5 to joint J1 can be reduced, whereby the amount of beer disposed of as waste liquid can be lessened. The same is true with regard to beer-detection sensor 35-2.

And while the implementations had the beer-detection sensor 39 disposed in the vicinity of where the waste-liquid connection tube H4 and the beer storage-keg switching device 12 connect, the implementations are not limited to those illustrated. For example, the beer-detection sensor 39 may be arranged in the vicinity of each of the liquid cutoff devices 33-1 and 33-2. This makes it possible to reduce the area from the part that branches from the first connection tube 23-1 to the beer-detection sensor 39. Thus, the amount of liquid that has to be disposed of as waste can be lessened. That means that the beer storage kegs can be economically, efficiently utilized.

(3) Status-Detection in Beer-Detection Sensors

In aforedescribed Embodiment Example 1 through Embodiment Example 7, the implementations had it that when bubbles inside the beer storage-keg connection tube H1 are detected in the beer detection sensor 35-1, it is determined that the beer in the beer storage keg 21-1 has run out, requiring that the beer storage keg 21-1 be replaced, and the liquid cutoff device 31-1 is put into the delivery-disabled state. The system, however, may be rendered so as to determine that if, after detecting bubbles inside the beer storage-keg connection tube H1, a state in which there is nothing further is sensed, replacing the beer storage keg 21-1 is necessary. There will be instances where foam froths out in the midst of beer being delivered. Determining in those instances that replacing the beer storage keg 21-1 is necessary would mean that a beer storage keg 21-1 in which beer still remains is replaced, which would be uneconomical. When beer is no longer present in the beer storage keg 21-1, nothing is any longer delivered to the beer storage-keg connection tube H1. Consequently, the beer-remaining state in the beer storage keg 21-1 can be more reliably determined by sensing the state of there being nothing inside the beer storage-keg connection tube H1. In turn, the beer can be used more efficiently.

(4) Beer Storage-Keg Replacement Button B

In aforedescribed Embodiment Example 1 and Embodiment Example 2, the implementations had it that on completion of beer storage keg 21-1 replacement, the beer storage-keg replacement button B is operated, dispatching replacement-completion information, but as long as they allow the completion of beer storage keg 21-1 replacement to be recognized the implementations are not limited to those illustrated. For example, the system may be rendered so as to determine that replacement of the beer storage keg 21-1 has been completed at the point when, after bubbles have been detected by the beer detection sensor 35-1, next beer is detected.

And the system may also be rendered so that at the connection operation when the beer storage keg 21-1 is replaced with a fresh keg and is connected with the beer storage-keg connection tube H1, in conjunction with an operation whereby a lever that is a connection-commencement notification means on the dispenser head—being the connection member that connects to the beer storage keg 21-1—is pushed down, connection-commencement information is transmitted to the CPU 411 to transmit the connection-commencement information. When the lever is pushed down, the beer storage-keg connection tube H1 and the beer storage keg 21-1 are completely connected, and initial-stage foam begins flowing from the beer storage keg 21-1. On the other hand, at the stage in which the lever has begun to be pushed down, the beer storage-keg connection tube H1 and the beer storage keg 21-1 are not completely connected, such that foam does not flow. Accordingly, transmitting the connection-commencement information at this stage and putting the liquid cutoff device 33-1 into the delivery-enabled state makes it possible to reliably conduct to the second connection tube 25-1 and discharge the foam that streams out simultaneously with complete connection with the beer storage keg 21-1.

(5) Completion of Beer Storage-Keg Replacement Preparation

In aforedescribed Embodiment Example 1 and Embodiment Example 2, the implementations had it that after the elapse of a predetermined time period following replacement of the beer storage keg 21-1, the liquid cutoff device 31-1 is put into the delivery-disabled state, but as long as they allow the conclusion of foam discharge to be sensed, the implementations are not limited to those illustrated. For example, the system may be rendered to put the liquid cutoff device 31-1 into the delivery-disabled state when beer is detected by the beer detection sensor 39, so as not to discharge beer to the waste-liquid receptacle WP via the second connection tube 25-1.

(6) Beer Storage-Keg 21-1 Replacement, and Delivery from Beer Storage-Keg 21-2

In aforedescribed Embodiment Example 1 and Embodiment Example 2, the implementations had it that beer is delivered from beer storage keg 21-2 in parallel with replacement of beer storage keg 21-1, but the system may be rendered so that the delivery of beer from beer storage keg 21-2 is stopped and exchanging of the beer storage keg 21-1 is carried out. In that case, the system may for example be rendered so that it puts the liquid cutoff device 33-2 into the delivery-disabled state when putting the liquid cutoff device 33-1 into the delivery-disabled state, and puts the liquid cutoff device 33-2 into the delivery-enabled state when it obtains the replacement-completion information.

(7) Pressure-Regulating Valve 72*b*

In aforedescribed Embodiment Example 2 and Embodiment Example 4, the system may be rendered so that operational control of the pressure-regulating valve 72*b* may be carried out by the CPU 411. For example, the system may be rendered with a temperature sensor provided on the beer storage-keg switching device 52, and to regulate the pressure of the carbon-dioxide supplied from the canister 72*a* according to numerical values from the temperature sensor. This makes possible a pressure supply corresponding to temperature variations due to the season or to air conditioning. Thus, beer can be supplied from the dispenser 11 at an appropriate pressure.

Also, the implementations had it that carbon dioxide adjusted to an appropriate pressure by the pressure-regulating valve 72*b* is delivered to the beer storage kegs 21-1 and 21-2 via the tank-connection tube H53 and joint J13, but the system may be configured so that the joint J13 is supplemented with the function of the pressure-regulating valve 72*b*. Furthermore, the system may be rendered so that the pressure-regulating valve function of the joint J13 is controlled by the CPU 411.

(8) Positional Relationship Between First Connection Tube 23-1 and Second Connection Tube 25-1, Etc.

Figure 25A:
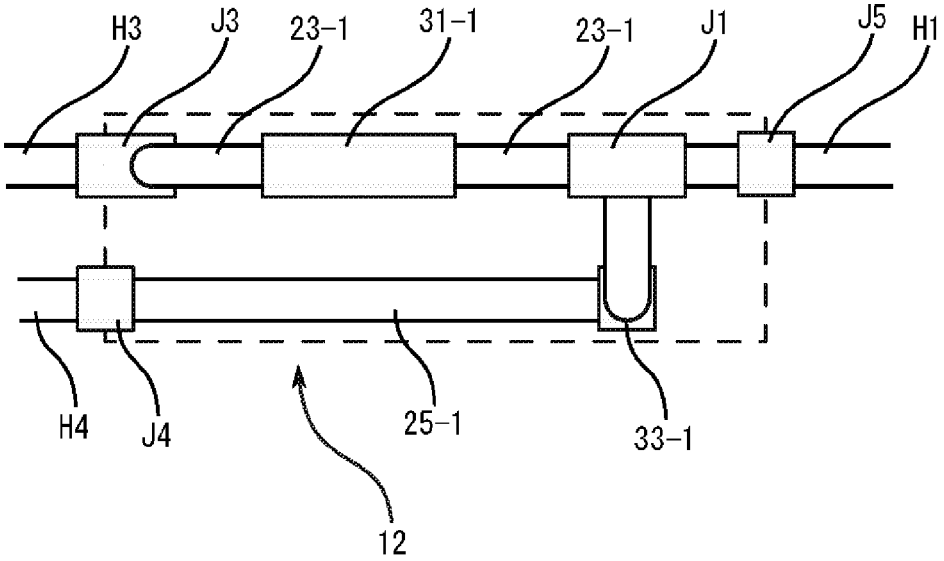
FIG. 25 is diagrams illustrating another configuration in the beer delivery system 1 and the beer delivery system 51.
Figure 25B:
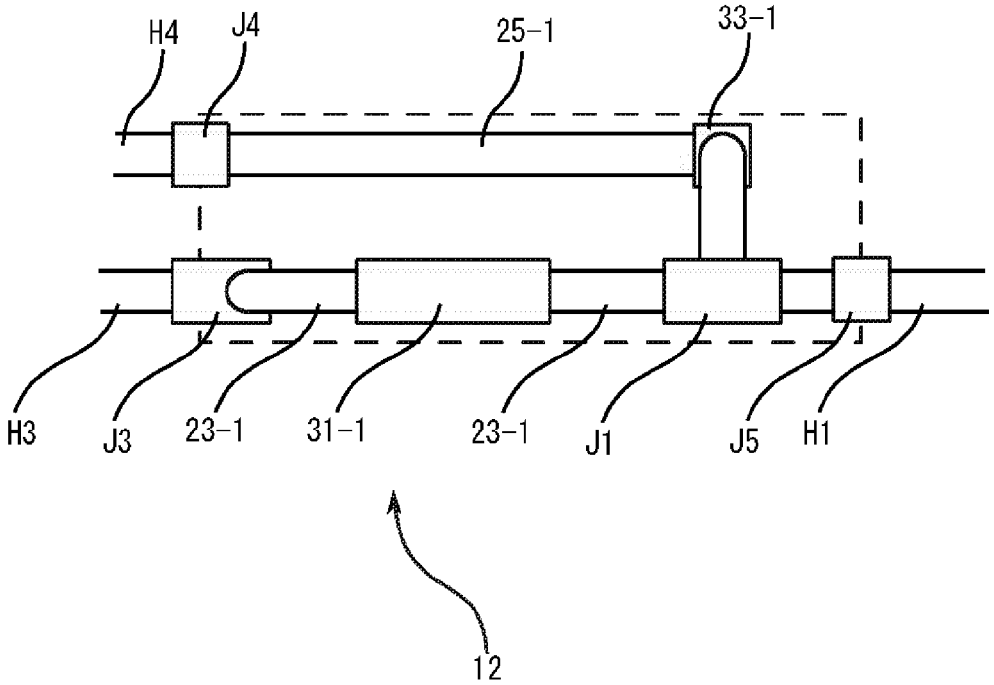

In aforedescribed Embodiment Example 1 through Embodiment Example 4, as illustrated in FIG. 25A, the first connection tube 23-1 was disposed higher than the second connection tube 25-1. As illustrated in FIG. 25B, however, the system may be rendered so that the second connection tube 25-1 is disposed higher than the first connection tube 23-1. The specific weight of bubbles and gas to be discharged is lighter than that of the beer or other liquid to be discharged. Therefore, disposing the second connection tube 25-1 in a location that is higher than the first connection tube 23-1 makes it possible to discharge the bubbles and gas reliably. It should be noted that FIG. 25 is diagram in which internal structure of the beer storage-keg switching device 52 illustrated in FIG. 12 and FIG. 13 is viewed from the left-hand side. The same goes for the first connection tube 23-2 and the second connection tube 25-2.

(9) Beer

Set forth in the aforedescribed Embodiment Example 1 through Embodiment Example 4 was that beer is delivered as the liquid, but many liquids are acceptable. For example, it may be milk. With milk, grime is prone cling to the first connection tube 23-1, etc. that is the flowpath. Consequently, in terms of hygiene management, it is necessary that washing be done frequently. Accordingly, utilizing a liquid delivery device involving the present invention makes it possible to furnish milk hygienically.

(10) Beer-Detection Sensor Placement Location

In aforedescribed Embodiment Example 3 and Embodiment Example 4, the implementations had it that the beer detection sensor 39 is disposed along the waste-liquid connection tube H4 in the vicinity of where it connects with the beer storage-keg switching device 12, but the implementations are not limited to those illustrated. For example, the beer detection sensor 39 may be arranged in the vicinity of the waste-liquid receptacle WP, or of where the waste-liquid connection tube H4 connects with the dispenser 11. Since that makes it possible to sense, in a location near the waste-liquid receptacle WP, the delivery status in the second connection tube 25-1, the delivery status of the second connection tube 25-1 can be reliably comprehended. For example, in instances where the beer detection sensor 39 has sensed a state in which nothing is flowing, it may be determined that the second connection tube 25-1 has reliably gone into an empty state.

(11) Method of Putting Second Connection Tube 25-1 into Delivery-Disabled State In aforedescribed Embodiment Example 3 and Embodiment Example 4, the implementations had it that following elapse of a predetermined time period after having been put into the delivery-enabled state, the second connection tube 25-1 is put into the delivery-disabled state, but as long as they let the second connection tube 25-1 be in an empty state, the implementations are not limited to those illustrated. For example, the system may be rendered with the beer detection sensor 39 arranged in the vicinity of the waste-liquid receptacle WP, or of where the waste-liquid connection tube H4 connects with the dispenser 11, and to sense that the second connection tube 25-1 has gone into an empty state and put it into the delivery-disabled state.

(12) Number of Beer Storage Kegs in Beer Delivery System

With aforedescribed Embodiment Example 3 and Embodiment Example 4, a beer delivery system having two beer storage kegs, 21-1 and 21-2, was rendered, but the beer delivery system may be one having a single beer storage keg. In that case, when delivery of beer from the beer storage keg 21-1 has concluded, rather than switch from beer storage keg 21-1 to beer storage keg 21-2, the system puts the second connection tube 25-1 into an empty state. Then, when the second connection tube 25-1 has gone empty, the beer storage keg is replaced and delivery of beer from the substitute beer storage keg is started.

(13) Timing of when Rupture-Prevention Countermeasure Executed

In aforedescribed Embodiment Example 4, the system was rendered for shifting automatically from State 2 into State 11, but may be rendered so as to transmit, in synch with the connection operation—e.g., the operation of pushing down the lever on the dispenser head that connects to the beer storage keg 21-1—when a fresh keg replaces the beer storage keg 21-1 and is connected with the beer storage-keg connection tube H1, connection-commencement information to the CPU 411 and shift from State 2 into State 11. When the lever is pushed down, completely connecting the beer storage-keg connection tube H1 and the beer storage keg 21-1, high pressure acts on the first connection tube 23-1 and the liquid cutoff device 33-1. On the other hand, the stage in which the lever has begun to be pushed down is prior to high pressure acting on the first connection tube 23-1 and the liquid cutoff device 33-1. Accordingly, putting the liquid cutoff device 33-1 at this stage into the delivery-enabled state makes it possible to secure the discharge path from the second connection tube 25-1 before high pressure acts at the moment the connection with the beer storage keg 21-1 is complete. The rupture-prevention countermeasure can thus be reliably carried out.

(14) Pressure-Switching Devices 73-1 and 73-2

In the beer delivery system involving aforedescribed Embodiment Example 2, Embodiment Example 4 and Embodiment Example 6, the pressure-switching devices 73-1 and 73-2 are utilized to supply the pressure in the carbon-dioxide tanks 22-1 and 22-2 to the delivery flowpaths and discharge flowpaths. A problem that arises therein is that should the pressure-switching devices 73-1 and 73-2 stop operating normally, due to a break in the wiring, a fault in the circuit board, a malfunction in the power source, etc., beer delivery and discharge no longer can take place. Given that, the system may be rendered so as to employ as the pressure-switching devices 73-1 and 73-2 machines that remain in the supply-enabled state at ordinary times. Pressure can thereby be supplied constantly, such that even in a situation where the pressure-switching devices 73-1 and 73-2 have stopped operating normally, continuing the delivery/discharge of beer is possible.

(15) Liquid Cutoff Devices 33-1 and 33-2

Figure 26:
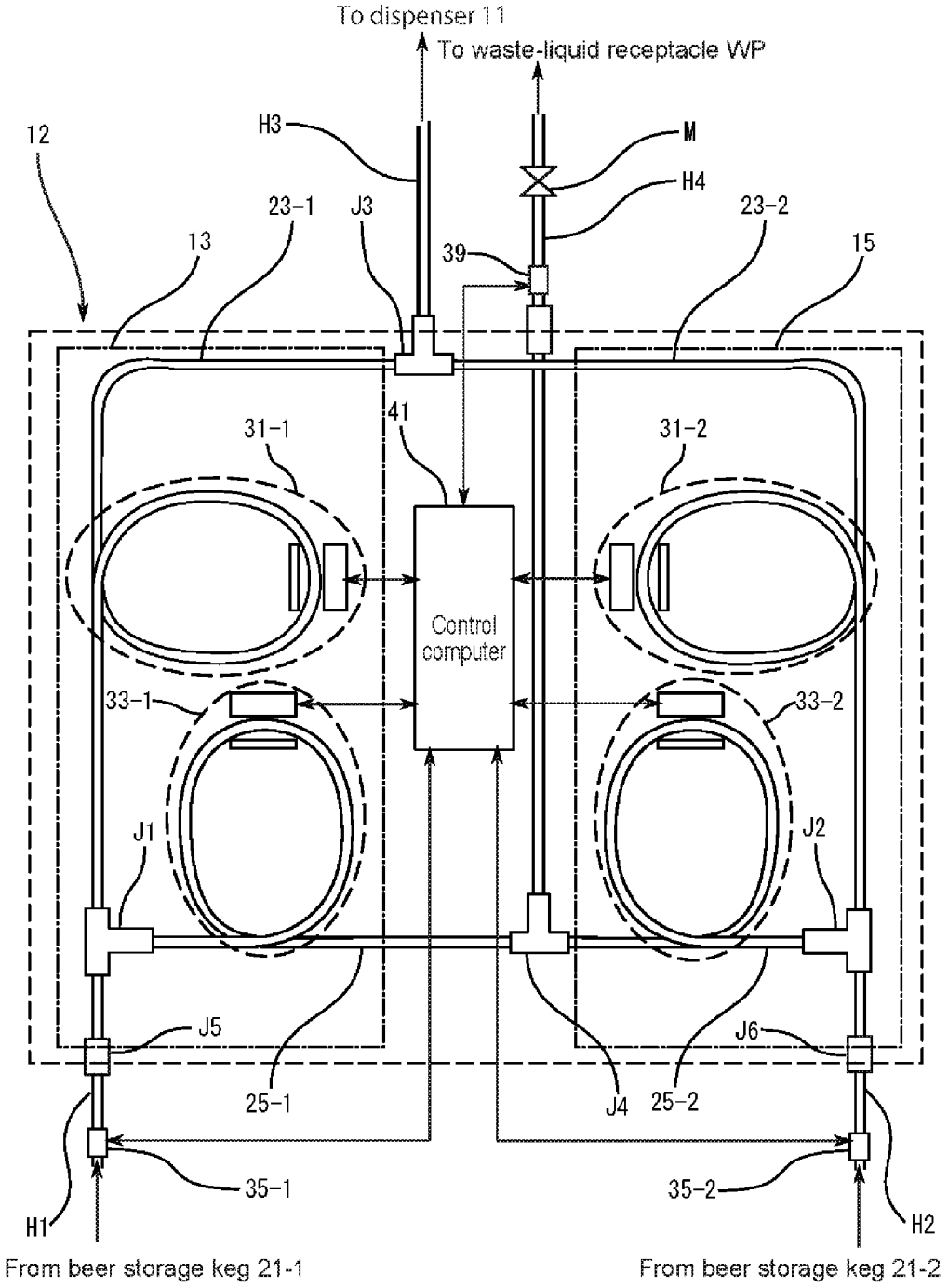
FIG. 26 is a diagram illustrating another configuration of a beer delivery system.
Figure 27:
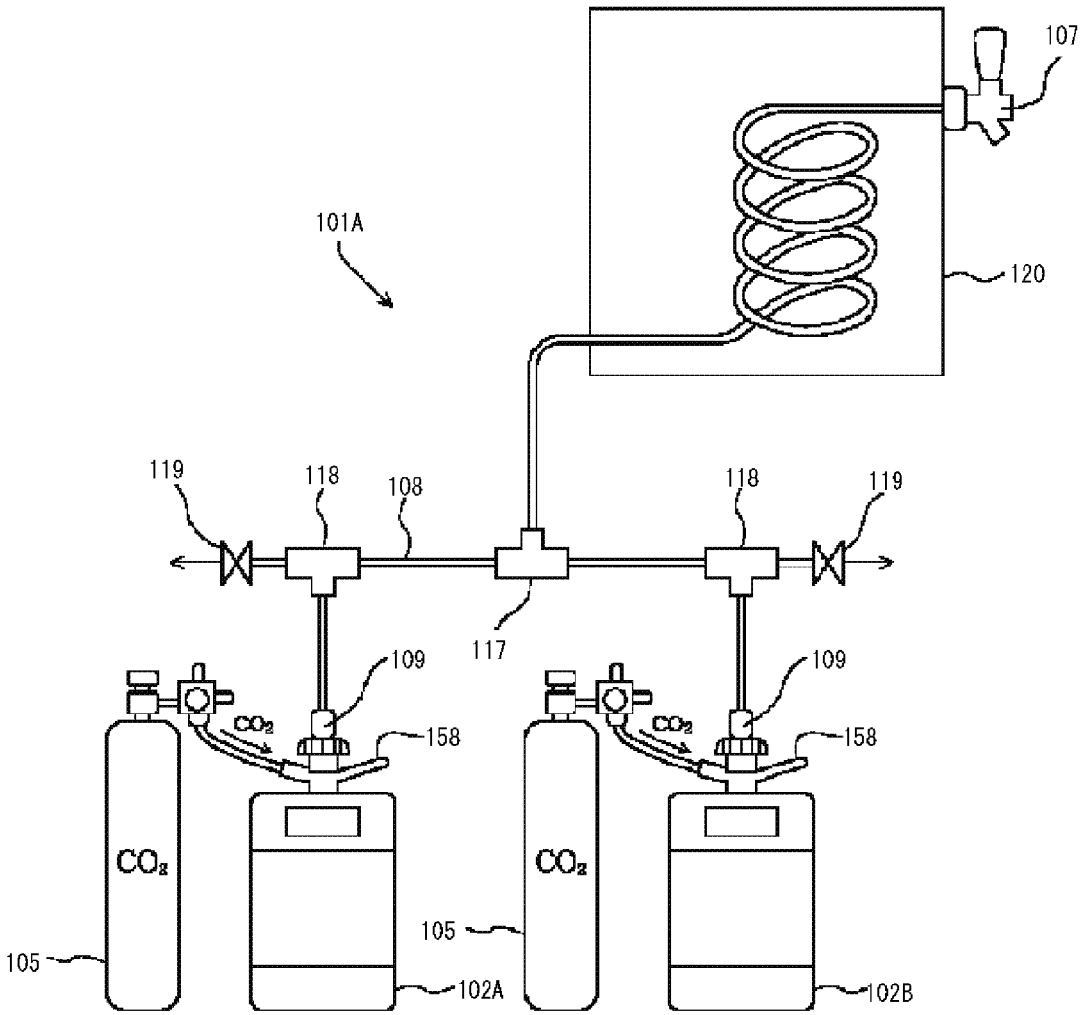
FIG. 27 PRIOR ART
FIG. 27 is a diagram illustrating the configuration of a beer tapping device that is a conventional liquid delivery system.

In aforedescribed Embodiment Examples 1 through 7, whether or not bubbles, etc. are discharged into the foam, etc. waste-liquid receptacle WP was controlled by the liquid cutoff devices 33-1 and 33-2. Problems with a possibility of arising in that case are that if the liquid cutoff devices 33-1 and 33-2 malfunction and cannot be put into the delivery-disabled state, beer and carbon-dioxide gas gush out via the discharge flowpath and beer cannot be delivered from the dispenser 11, or that a large volume of beer gushes out to the exterior via the discharge flowpath, dirtying the store, or other such trouble. Given that, the system may be rendered, as illustrated in FIG. 26, arranging, along the waste-liquid flowpath to the waste-liquid receptacle side of the liquid cutoff devices 33-1 and 33-2—for example, in the waste-liquid connection tube H4—so as to be in series with the liquid cutoff devices 33-1 and 33-2, a switching device M with which manually switching between the delivery-enabled state and the delivery-disabled state is possible.

(16) Second Connection Tubes 25-1 and 25-2

In aforedescribed Embodiment Example 1 through Embodiment Example 7, the liquid cutoff devices 33-1 and 33-2 were formed with the second connection tubes 25-1 and 25-2 adopting a looped formation. In that respect, during business hours at a business establishment the liquid cutoff devices 33-1 and 33-2 will as general rule be in the delivery-disabled state. Consequently, if the beer storage-keg switching devices 2 and 52 are situated in a place where the temperature goes high, it can happen that, on account of the second connection tubes 25-1 and 25-2 swelling or due to a similar cause, the devices' ability to block beer in the discharge flowpath will deteriorate, giving rise to liquid leakage. Given that, the system may be rendered to counter liquid leakage by having the tubular thickness of the second connection tubes 25-1 and 25-2 be thicker-walled than the first connection tubes 23-1 and 23-2. It should be noted that the fact that utilizing thick-walled tubing may effectively stop liquid leakage is an insight by the inventors. And it will be appreciated that the specific tubular thickness of the first connection tubes 23-1 and 23-2 and the second connection tubes 25-1 and 25-2 should be decided taking into consideration conditions including the material properties of the tubes, the diameter of the liquid cutoff device 33-1 and 33-2 loops, and the pressure when the beer is discharged.

Industrial Applicability

A liquid delivery system involving the present invention can be utilized, for example, for a beer dispenser system that dispenses beer.

EXPLANATION OF REFERENCE MARKS

1, 51: beer delivery systems
11: dispenser
12, 52: beer storage-keg switching devices
21-1, 21-2: beer storage kegs
22-1, 22-2, 72: carbon dioxide tanks
H1, H2: beer storage-keg connection tubes
H3: dispenser connection tube
H4: waste-liquid connection tube
H5, H6, H7, H8: tank connection tubes
B: beer storage-keg replacement button
23-1, 23-2: first connection tubes
25-1, 25-2: second connection tubes
31-1, 31-2, 33-1, 33-2: liquid cutoff devices
35-1, 35-2, 39: beer-detection sensors
J1, J2, J3, J4, J5, J6: joints
41: control computer

The invention claimed is:

1. A liquid-delivery switching device for switching among a plurality of liquid-storage vessels storing a liquid, and delivering the liquid to a liquid external-delivery device delivering the liquid externally, the liquid-delivery switching device comprising:

a pair of liquid-delivery network sections, each for liquid-supply connection with at least one of the plurality of liquid-storage vessels, each liquid-delivery network section including a delivery tube of material allowing the tube to be readily kinked and un-kinked, one end of said delivery tube being a supply end and the other end being a delivery end, said delivery tube being crossed over into a delivery-cutoff loop between the supply end and the delivery end, and said delivery tube being fitted with a branch joint between the supply end and the delivery-cutoff loop, a discharge tube of material allowing the tube to be readily kinked and un-kinked, one end of said discharge tube being a branch-joint end connected to said branch joint, and the other end being a discharge end, said discharge tube being crossed over into a discharge-cutoff loop between the branch-joint end and the discharge end, loop-support parts disposed alongside the crossed-over portion of the delivery-cutoff loop and the discharge-cutoff loop, and loop-shifting parts disposed clamping the delivery-cut-off loop and the discharge-cutoff loop opposite said loop-support parts, wherein the delivery-cutoff loop and the discharge-cutoff loop, said loop-support parts, and said loop-shifting parts constitute respective delivery and discharge cutoff devices;

drive means for driving each said loop-shifting part to shift toward the opposite said loop-support part such as to bend said loop into two opposing kinks thereby cutting off fluid flow through the loop, and for driving each said loop-shifting part to shift away from the opposite said loop-support part such as to undo the opposing kinks thereby allowing fluid flow through the loop;

a delivery conduit comprising the delivery tube of each of said pair of liquid-delivery network sections, an external-device connection tube, and a delivery-end joint through which the delivery ends of said delivery tubes of said pair of liquid-delivery network sections are connected with each other and said external-device connection tube, the supply ends of said delivery conduit each being configured for detachable connection with a replaceable liquid-storage vessel;

a discharge conduit comprising the discharge tube of each of said pair of liquid-delivery network sections, a waste-receptacle connection tube, and a discharge-end joint through which the discharge ends of said discharge tubes of said pair of liquid-delivery network sections are connected with each other and said waste-receptacle connection tube;

fluid sensing means in said delivery conduit and in either the waste-receptacle connection tube or the discharge ends of said discharge conduit, for sensing fluid-flow status in said delivery conduit and in said discharge conduit, as flow therein of liquid, of air, or of a liquid/air mixture;

control means associated with said fluid sensing means for controlling, in response to flow-status information from said fluid sensing means, said drive means and said delivery and discharge cutoff devices in said liquid-delivery network sections such as to allow liquid-delivery flow through one of said pair of said liquid-delivery network sections while cutting off liquid-delivery flow through the other of said pair of said liquid-delivery network sections, depending on the fluid-flow status in each of said liquid-delivery network sections, allow liquid-discharge flow through the one of said pair of said liquid-delivery network sections through which liquid-delivery flow is cut off, conditional on said control means receiving an indication of change in fluid-flow status of the delivery-cut-off liquid-delivery network section, and switch between allowing and cutting off liquid-delivery flow through said pair of said liquid-delivery network sections such that liquid flow through said delivery conduit is uninterrupted.

2. A liquid-delivery switching device according to claim 1, further comprising a replacement completion means for presenting to said control means replacement-complete information indicating, as the indication of change in fluid-flow status of the delivery-cut-off liquid-delivery network section, that a pre-changeover liquid-storage vessel has been replaced with a fresh vessel, wherein said control means has a replacement-complete-information acquisition means for acquiring the replacement-complete information from said replacement completion means.

3. A liquid-delivery switching device according to claim 1, connection-commencement notification means provided on the supply ends of said delivery conduit, for presenting to said control means connection-commencement information, as the indication of change in fluid-flow status of the delivery-cut-off liquid-delivery network section, when connection between a liquid-storage vessel and said delivery conduit begins, wherein said control means has a connection-commencement-information acquisition means for acquiring the connection-commencement information from said connection-commencement notification means.

4. A liquid-delivery switching device according to claim 1, wherein in response to said sensing means in the waste-receptacle connection tube or the discharge ends of said discharge conduit, said control means, following elapse of a predetermined period of time after allowing liquid-discharge flow through the one of said pair of said liquid-delivery network sections through which liquid-delivery flow is cut off, furthermore controls said drive means and said delivery and discharge cutoff devices such as to cut off liquid-discharge flow through the delivery-cut-off liquid-delivery network section.

5. A liquid-delivery switching device according to claim 1, wherein said control means controls said drive means and said delivery and discharge cutoff devices such as to cut off liquid-discharqe flow through the one of said pair of said liquid-delivery network sections through which liquid-delivery flow is cut off, conditional on said control means determining that the fluid-flow status in the discharge tube of the delivery-cut-off liquid-delivery network section is that the flow is at least a liquid/air mixture.

6. A liquid-delivery switching device according to claim 1, further including:

a pressure supply means for supplying pressure in order to deliver the liquid from the liquid-storage vessels;

pressure-supply conduits connected with each of the plurality of liquid-storage vessels; and pressure-supply conduit opening/closing means for switching between a pressure-supply enabled state in which via whichever of the pressure-supply conduits, supplying pressure to the liquid-storage vessel connected to that pressure-supply conduit is possible, and a pressure-supply disabled state in which supplying pressure to that liquid-storage vessel is not possible.

7. A liquid-delivery switching device according to claim 6, wherein said control means is further for:

controlling said switching-control means to put the pressure-supply conduit opening/closing means supplying pressure to a pre-replacement liquid-storage vessel for the flow-cutoff liquid-delivery network section into the pressure-supply disabled state, and to put the pressure-supply conduit opening/closing means supplyinq pressure to a post-replacement liquid-storage vessel into the pressure-supply enabled state; and with the replacing liquid-storage vessel and said delivery conduit being connected following the liquid-storage vessel replacement for the flow-cutoff liquid-delivery network section, controlling said switching-control means to put the pressure-supply conduit opening/closing means supplyinq pressure to the replacing liquid-storage vessel into the pressure-supply enabled state.

8. A liquid-delivery switching device according to claim 6, wherein said pressure-supply conduit opening/closing means further is ordinarily in the supply-enabled state.

9. A liquid-delivery switching device according to claim 1, wherein said discharge conduit is disposed in a location vertically elevated with respect to said delivery conduit.

10. A liquid-delivery switching device according to claim 1, wherein the liquid is beer.

11. A liquid-delivery switching device according to claim 1, wherein said discharge conduit is of thickness allowing the conduit to sustain the delivery-disabled state against changes in temperature.

* * * * *